US005420004A

United States Patent [19]

Fujita et al.

[11] Patent Number: 5,420,004

[45] Date of Patent: May 30, 1995

[54] DIRECT POSITIVE SILVER HALIDE EMULSION AND COLOR DIFFUSION TRANSFER LIGHT-SENSITIVE MATERIAL THEREWITH

[75] Inventors: Munehisa Fujita; Toru Sano, both of Kanagawa, Japan

[73] Assignee: Fuji Photo Film Co., Ltd., Kanagawa, Japan

[21] Appl. No.: 103,705

[22] Filed: Aug. 10, 1993

[30] Foreign Application Priority Data

Aug. 10, 1992 [JP] Japan ..... 4-257540

[51] Int. Cl.[6] ..... G03C 1/053; G03C 1/485; G03C 8/10

[52] U.S. Cl. ..... 430/559; 430/217; 430/569; 430/599; 430/600; 430/603; 430/627; 430/628; 430/629; 430/630

[58] Field of Search ..... 430/599, 600, 603, 628, 430/627, 629, 630, 217, 569, 559

[56] References Cited

U.S. PATENT DOCUMENTS

| | | | |
|---|---|---|---|
| 3,615,624 | 10/1971 | Smith et al. | 430/629 |
| 3,690,888 | 9/1972 | Bacon et al. | 430/629 |
| 3,860,428 | 1/1975 | Ponticello et al. | 430/629 |
| 4,400,463 | 8/1983 | Maskasky | 430/629 |
| 4,431,730 | 2/1984 | Urabe et al. | 430/630 |
| 4,431,731 | 2/1984 | Sugimoto et al. | 430/600 |

*Primary Examiner*—Richard L. Schilling
*Attorney, Agent, or Firm*—Sughrue, Mion, Zinn, Macpeak & Seas

[57] ABSTRACT

An internal latent image type positive silver halide emulsion has improved sensitivity reduction in low illuminance exposures. A color diffusion transfer light-sensitive material incorporates the emulsion and has reduced sensitivity reduction. The internal latent image type positive silver halide emulsion is prepared using a polymer having a repetitive unit derived from an ethylenically unsaturated monomer having at least one thioether structure on a side chain as a deflocculating agent to form silver halide grains and subjecting the grain surfaces to a chemical sensitization in the presence of a polymer having a repetitive unit represented by the following Formula (I):

(I)

wherein $R^1$ represents a hydrogen atom or a substituted or unsubstituted alkyl group and Q represents a group selected from the group consisting of groups represented by the following Formula (1) to Formula (4):

(1)

wherein q represents an integer of 2 to 4;

(2)

wherein $R^2$ and $R^3$ each independently represents a hydrogen atom or a substituted or unsubstituted alkyl group;

(3)

wherein $Z^1$ represents a group of atoms necessary to form a substituted or unsubstituted lactam ring, a substituted or unsubstituted oxazolidone ring, or a substituted or unsubstituted pyridone ring; and A represents a single bond, a —C(=O)— group, or a group represented by the following Formula (3*a*):

(Abstract continued on next page.)

$$-\underset{\underset{O}{\|}}{C}-B\left(CH_2\right)_k \qquad (3a)$$

wherein B represents an —O— group or an —N($R^4$)— group, in which $R^4$ represents a hydrogen atom or a substituted or unsubstituted alkyl group; and k represents an integer of 1 to 6;

$$-A-\underset{(CH_2)_n}{\overset{(CH_2)_m}{N}}\!\!\!

DIRECT POSITIVE SILVER HALIDE EMULSION AND COLOR DIFFUSION TRANSFER LIGHT-SENSITIVE MATERIAL THEREWITH

FIELD OF THE INVENTION

The present invention relates to an internal latent image type direct positive silver halide emulsion and a color diffusion transfer light-sensitive material using the emulsion.

BACKGROUND OF THE INVENTION

Photographic methods in which a silver halide is used provide excellent sensitivity and gradational characteristic compared with other photographic methods, for example, an electronic photographic method and a diazo photographic method, and are widely used. Among the methods using a silver halide, a method for forming a direct positive image is known. The object of this method is to obtain a positive image by giving an even exposure or by using a nucleating agent in developing an internal latent image type direct positive silver halide emulsion in a surface developing solution (a developing solution for leaving an internal latent image-forming site present in the inside of a silver halide grain without substantially developing ), as shown in, for example, U.S. Pat. No. 3,761,276 and JP-B-60-55821 (the term "JP-B" as used herein means an examined Japanese patent publication). Such a direct positive silver halide emulsion has an advantage over a negative type emulsion due to its capability of providing a positive image by only one processing.

In general, an internal latent image type direct positive silver halide emulsion can be prepared via the steps of mixing a soluble silver salt and a soluble halide in an aqueous gelatin solution to form silver halide grains (core grains), followed by subjecting the core grains to a chemical sensitization and then to a silver halide deposition for forming a shell and thereafter carrying out desalting and a chemical sensitization according to necessity.

An internal latent image type emulsion which is useful as a direct positive emulsion is described in, for example, JP-B-52-34213 (U.S. Pat. No. 3,761,276). This emulsion is characterized in that it contains a doping agent in the silver halide grains and in that the surface of the grains is subjected to a chemical sensitization. This is disclosed as well in U.S. Pat. No. 3,317,322, Porter et al.

However, the internal latent image type direct positive silver halide emulsion thus prepared also has a large sensitivity reduction phenomenon (a low illuminance inversion) which is still large when compared with that of a negative type emulsion, which occurs when the exposing illuminance intensity is lowered, and there is still room for improvement.

Gelatin has been used for many years as a deflocculating agent in the preparation of silver halide emulsions. The reasons therefor are: first, it is a good protective colloid; and secondly, it is easy to handle because of easy sol—gel conversion and coating is possible. However, gelatin has defects in that it is susceptible to decomposition attributable to bacteria and fungi and in that its quality is apt to vary widely since it is manufactured from an organism. There are many unknowns regarding the unfavorable photographic effects originating in the use of gelatin and accordingly, a deflocculating agent improved over gelatin or an improved method of applying gelatin has been desired in the art.

It is already known to use a synthetic polymer in place of gelatin as a method for overcoming these problems. It is known as well to use as a deflocculating agent a polymer having a repetitive unit derived from an ethylenically unsaturated monomer containing at least one a thioether structure. Such polymers are described in U.S. Pat. Nos. 3,615,624, 3,536,677, 3,692,753, 3,690,888, 3,679,425, 3,706,564, 3,706,565, 3,713,833, 3,840,628, and 4,400,463, Research Disclosure vol. 104, pp. 44 to 48, and Journal of Imaging Science, vol. 31, pp. 148 to 156. Chemical sensitizing methods and examples of direct positive emulsions are described in these patents and publications. However, the chemical sensitizing methods described in the publications other than U.S. Pat. No. 3,690,888 are chemical sensitizations for a negative emulsion; and the direct positive emulsion described in U.S. Pat. No. 3,690,888 is a pre-fogged direct positive emulsion. Thus, there appear to be no descriptions in the literature regarding an internal latent image type direct positive silver halide emulsion which is not fogged in advance as is the case in the present invention.

In the technical field of direct positive silver halide emulsions, pre-fogged direct positive emulsions were researched and developed to provide the above mentioned internal latent image type direct positive silver halide emulsion which enables one to obtain a positive image by giving an even exposure or by using a nucleus-forming agent. In this process, the sensitivity and S/N (the ratio of signal/noise) were improved to a large extent.

In recent years, the superiority of internal latent image type direct positive silver halide emulsions has been enhanced more and more as progress has been made in the field of direct positive image-forming methods. With respect to deflocculating agents, it is expected that research on deflocculating agents will lead to improvements in the performance of internal latent image type direct positive silver halide emulsions and in the development of the applying method thereof.

Meanwhile, in internal latent image type direct positive silver halide emulsions, chemical sensitizing methods for the grain surfaces play a particularly important part and the techniques regarding chemical sensitization have been disclosed.

A method for preparing an internal latent image type core/shell emulsion which is useful as a direct positive emulsion is described in, for example, JP-A-57-136641 (the term "JP-A" as used herein means an un-examined Japanese patent application). This method is characterized in that the surface of the core/shell silver halide grains of the internal latent image type emulsion containing the silver halide grains consisting of an inner nucleus (core) of silver halide which is doped with a metal ion or chemically sensitized or subjected to both of those treatments and an outer covering (shell) of silver halide covering at least a light-sensitive site in the inner nucleus is subjected to a chemical ripening in the presence of a polymer such as poly(N-vinylpyrrolidone), poly(N-vinyloxazolidone), a vinyl alcohol, N-vinylpyrrolidone copolymer, and an N-vinyl-pyrrolidone—vinyl acetate copolymer. In JP-A-57-136641, however, only gelatin was used as a deflocculating agent in forming the grains and the improvement in low illuminance inversion characteristics was still insufficient.

SUMMARY OF THE INVENTION

An object of the present invention is to provide an internal latent image type positive silver halide emulsion which is improved in sensitivity reduction (low illuminance inversion) in exposures at low illuminance intensities and to provide a color diffusion transfer light-sensitive material in which the emulsion is used and the low illuminance inversion is reduced.

This object has been achieved by the internal latent image type positive silver halide emulsion described in the following Item (1) and by the color diffusion transfer light-sensitive material in which it is used described in the following Item (2).

(1) An internal latent image type positive silver halide emulsion prepared by using a polymer having a repetitive unit derived from an ethylenically unsaturated monomer having at least one thioether structure on a side chain as a deflocculating agent to form silver halide grains and subjecting the grain surfaces to a chemical sensitization in the presence of a polymer having a repetitive unit represented by the following Formula (I):

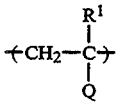

(I)

wherein $R^1$ represents a hydrogen atom or an alkyl group and Q represents a group selected from the group consisting of groups represented by the following Formula (1) to Formula (4):

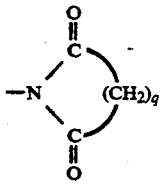

(1)

wherein q represents an integer of 2 to 4;

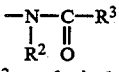

(2)

wherein $R^2$ and $R^3$ each independently represents a hydrogen atom or an alkyl group;

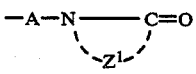

(3)

wherein $Z^1$ represents a group of atoms necessary to form a lactam ring, an oxazolidone ring, or a pyridone ring; and A represents a single bond, a —C(=O)— group, or a group represented by the following Formula (3*a*):

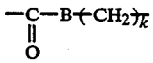

(3a)

wherein B represents an —O— group or an —N($R^4$)— group, in which $R^4$ represents a hydrogen atom or an alkyl group; and k represents an integer of 1 to 6;

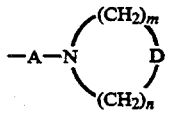

(4)

wherein A has the same meaning as A in the above Formula (3); D represents a single bond, an —O— group or an —N($R^5$)— group; m and n each represents an integer of 1 to 6, which satisfy the relationship of m+n=4 to 7, in which $R^5$ represents a hydrogen atom, an alkyl group, or a group represented by the following Formula ( 4*a*):

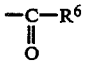

(4a)

wherein $R^6$ represents an alkyl group.

The alkyl group represented by $R^1$ may be substituted by substituent(s) and is preferably those having 1 to 4 carbon atoms. Examples of the substituent include a halogen atom (e.g., Cl and Br) and a —COOH group.

The alkyl group represented by $R^2$ may be substituted by substituent(s) and is preferably those having 1 to 4 carbon atoms. Examples of the substituent include a hydroxyl group, an alkoxy group, a phenoxy group, and a halogen atom.

The alkyl group represented by $R^3$ may by substituted by substituent(s) and is preferably those having 1 to about 12 carbon atoms. Examples of the substituent include a halogen atom, an alkoxy group, an alkoxycarbonyl group, an alkylamido group, an alkylcarbamoyl group, an acyl group, an acyloxy group, a cyano group and a phenoxy group.

The lactam ring, oxazolidone ring, or pyridone ring comprising $Z^1$ may be substituted by substituent(s). Examples of the substituent include a substituted or unsubstituted alkyl group and a substituted or unsubstituted aryl group.

The alkyl group represented by $R^4$ may be substituted by substituent(s) and is preferably those having 1 to 4 carbon atoms. Examples of the substituent are the same as those for the alkyl group represented by $R^2$.

The alkyl group represented by $R^5$ may be substituted by substituent(s) and is preferably those having 1 to 6 carbon atoms. Examples of the substituent are the same as those for the alkyl group represented by $R^2$.

(2) A color diffusion transfer light-sensitive material comprising a support having provided thereon at least one silver halide emulsion layer combined with a dye image-forming compound (which is present in the silver halide emulsion layer and/or a different layer), the dye image-forming being represented by the following Formula (II) and consisting of a non-diffusible compound capable of releasing a diffusible dye or a precursor thereof in relation to a silver development or a compound in which the diffusibility of the compound itself changes during development, wherein at least one silver halide emulsion layer contains an internal latent image type positive silver halide emulsion as described in Item (1) above:

$$(DYE\text{-}Y)_n-Z \qquad \text{(II)}$$

wherein DYE represents a dye group, a dye group which is temporarily shifted to a short wavelength, or a dye precursor group; Y represents a single bond or a linking group; Z represents a group which makes difference in the diffusibility of the compound represented by $(DYE\text{-}Y)_n-Z$ in correspondence to or counter correspondence to light-sensitive silver salt having a imagewise latent image or releases Dye to make difference in the duffusibility between Dye thus released and $(DYE\text{-}Y)_n-Z$ in correspondence to or counter correspondence to light-sensitive silver salt having a imagewise latent image; n represents 1 or 2; and when n is 2, the two DYE-Y's may be the same or different.

DETAILED DESCRIPTION OF THE INVENTION

The above polymer having at least one thioether structure on a side chain, which is used as a deflocculating agent in the present invention, will be explained below.

The polymer which is represented by the following Formula (A) and has a repetitive unit derived from an ethylenically unsaturated monomer having a thioether structure on a side chain can be enumerated as a preferred example of the polymer having at least one thioether structure on a side chain according to the present invention:

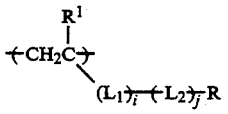

(A)

wherein $R^1$ represents a hydrogen atom, an alkyl group having a carbon number of 1 to 4, or a chlorine atom; $L^1$ represents—$CON(R^2)$—, in which $R^2$ represents a hydrogen atom, an alkyl group having a carbon number of 1 to 4, or a substituted alkyl group having a carbon number of 1 to 6, —COO—, —NHCO—, —OCO—, or a group represented by the following Formula (5) or Formula (6); $L^2$ represents a linking group connecting $L^1$ with R; i represents 0 or 1; j represents 1 or 2; and R represents a monovalent substituent;

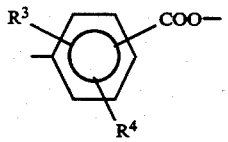

(5)

wherein $R^3$ and $R^4$ each independently represents a hydrogen atom, a hydroxyl group, a halogen atom, an alkyl group, an alkoxy group, an acyloxy group, or an aryloxy group, each being substituted or unsubstituted;

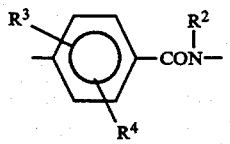

(6)

wherein $R^2$, $R^3$ and $R^4$ have the same meanings as given above. To be specific, the linking group represented by $L^2$ is represented by the following Formula (7):

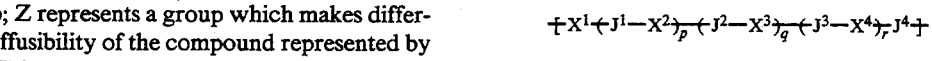

(7)

wherein $J^1$, $J^2$, $J^3$, and $J^4$, which may be the same or different, each represents —CO—; —$SO_2$—; —$CON(R^5)$—, in which $R^5$ represents a hydrogen atom, an alkyl group (carbon number of 1 to 6) or a substituted alkyl group (carbon number of 1 to 6); —$SO_2N(R^5)$—, in which $R^5$ has the same defined meaning given above, —$N(R^5)$—$R^6$—, in which $R^5$ has the same meaning given above and $R^6$ represents an alkylene group having a carbon number of 1 to 4); —$N(R^5)$—$R^6$—$N(R^7)$—, in which $R^5$ and $R^6$ have the same meanings as given above and $R^7$ represents a hydrogen atom, an alkyl group (carbon number of 1 to 6), or a substituted alkyl group (carbon number of 1 to 6); —O—, —S—, —$N(R^5)$—CO—$N(R^7)$—, in which $R^5$ and $R^7$ have the same meanings as given above; —$N(R^5)$—$SO_2$—N(RT)—, in which $R^5$ and $R^7$ have the same meanings as given above; —COO—; —OCO—, —$N(R^5)CO_2$—, in which $R^5$ has the same meaning as given above; and —$N(R^5)$CO—, in which $R^5$ has the same meaning as given above; $X^1$, $X^2$, $X^3$ and $X^4$ may be the same or different and each represents an alkylene group, a substituted alkylene group, an arylene group, a substituted arylene group, an aralkylene group, or a substituted aralkylene group; and p, q, and r each represents 0 or 1, provided that p, q and r are not 0 at the same time.

$L^2$ contains at least one thioether structure.

In the above formula, $X^1$, $X^2$, $X^3$, and $X^4$ each preferably represents a substituted or unsubstituted alkylene group having a carbon number of 1 to 10, a substituted or unsubstituted aralkylene group, or a substituted or unsubstituted phenylene group, and the alkylene group may be linear or branched. Examples of the alkylene group include, for example, methylene, methylmethylene, dimethylmethylene, dimethylene, trimethylene, tetra-methylene, pentamethylene, hexamethylene, and decylmethylene. Examples of the aralkylene group include, for example, benzyl-idene. Examples of the phenylene group include, for example, p-phenylene, m-phenylene, and methylphenylene.

There can be enumerated as the substitutents for the alkylene group, aralkylene group, or phenylene group represented by $X^1$, $X^2$, $X^3$ and $X^4$, a halogen atom, a nitro group, a cyano group, an alkyl group, a substituted alkyl group, an alkoxy group, a substituted alkoxy group, —$NHCOR^8$ in which $R^8$ represents an alkyl group, a substituted alkyl group, a phenyl group, a substituted phenyl group, an aralkyl group, or a substituted aralkyl group, —$NHSO_2R^8$, —$SOR^8$, —$SO_2R^8$, —$COR^8$, a group represented by the following Formula (8), a group represented by the following Formula (9), an amino group (which may be substituted with an alkyl group), a hydroxy group, and a group which decomposes to form a hydroxy group; when two or more of these substituents are present, they may be the same as or different from each other:

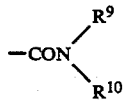

(8)

wherein $R^9$ and $R^{10}$ may be the same or different and each represents a hydrogen atom, an alkyl group, a substituted alkyl group, a phenyl group, a substituted phenyl group, an aralkyl group, or a substituted aralkyl group:

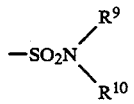

(9)

wherein $R^9$ and $R^{10}$ have the same meanings as given above.

There can be enumerated as the substituents for the above substituted alkyl group, substituted alkoxy group, substituted phenyl group, and substituted aralkyl group, a hydroxy group, a nitro group, an alkoxy group having a carbon number of about 1 to about 4, $—NHSO_2R^8$, in which $R^8$ has the same meaning as given above, $—NHCOR^8$, the groups represented by the above Formulas (8) and (9), $—SO_2R^8$, $—COR^8$, a halogen atom, a cyano group, and an amino group (which may be substituted with an alkyl group).

In Formula (A), R represents a monovalent substituent. To be specific, R represents a substituted or unsubstituted alkyl group having a carbon number of 1 to 20, or a substituted or unsubstituted aryl group having a carbon number of 6 to 20. There can be enumerated as the alkyl group, methyl, ethyl, n-propyl, isopropyl, n-butyl, t-butyl, n-hexyl, n-octyl, and n-dodecyl. There can be enumerated as the substituents for the alkyl group and aryl group, similarly to those described for the above-mentioned $X^1$, $X^2$, $X^3$, and $X^4$, a halogen atom, a nitro group, a cyano group, an alkyl group, a substituted alkyl group, an alkoxy group, a substituted alkoxy group, $—NHCOR^8$, in which $R^8$ represents an alkyl group, a substituted alkyl group, a phenyl group, a substituted phenyl group, an aralkyl group, or a substituted aralkyl group, $—NHSO_2R^8$, $—SOR^8$, $—SO_2R^8$, $—COR^8$, the groups represented by the above Formulas (8) and (9), an amino group (which may be substituted with an alkyl group), a hydroxy group, and a group which decomposes to form a hydroxy group.

Next, representative specific examples of ethylenically unsaturated monomer providing the repetitive unit represented by Formula (A) will be given below:

3-thiapentyl acrylate
2-thiabutyl acrylate
3-thiapentyl methacrylate
2-thiabutyl methacrylate
N-(3-thiapentyl) acrylamide
N-(3-thiabutyl) acrylamide
N-(3-thiapentyl) methacrylamide
5-thiaheptyl acrylate
N-(7-thiapentyl) acrylamide
N-(3-thiaoctyl) acrylamide
N-(7-thianonyl) acrylamide
N-(2,5-dimethyl-4-thiahexyl) methacrylamide
N-acryloymethionine
N-methacryloymethionine
N-acryloymethionine methyl ester
N-(3,6-dithiaheptyl) acrylamide
N-[2,2-bis(1-thiapropyl) ethyl]acrylamide
$CH_2=CH—COOCH_2CH_2OCOCH_2CH_2COOCH_2CH_2SCH_2CH_3$

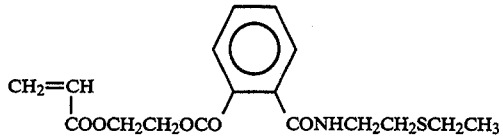

3-thiapentyl-4-vinylbenzoate
$CH_2=CH—CONHCH_2COOCH_2CH_2SCH_2CH_3$
$CH_2=CH—CONH(CH_2)_3COOCH_2CH_2SCH_2CH_3$ The polymer having a repetitive unit represented by Formula (A) in the present invention is preferably water soluble and other ethylenically unsaturated monomers may be copolymerized therewith according to necessity. The term "water-soluble" means capability of dissolving in distilled water at 25° C. at a concentration of 1% by weight or more.

The particularly preferred ethylenically unsaturated monomers which can be copolymerized with the polymer having a repeating unit reprented by Formula (A) are such that the homopolymers thereof are soluble in water or and aqueous acid solution or aqueous alkali solution. To be specific, there can be enumerated the nonionic monomers such as acrylamide, methacrylamide, N-methylacrylamide, N,N-dimethylacrylamide, N-acryloylmorpholine, N-ethyl-acrylamide, and N-vinylpyrrolidone; the monomers having an anionic group, such as:

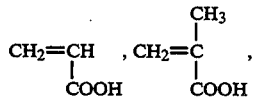

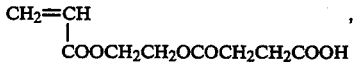

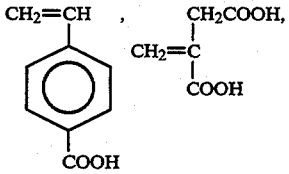

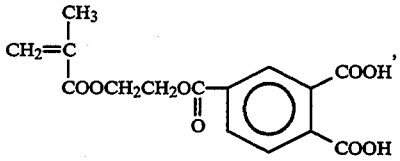

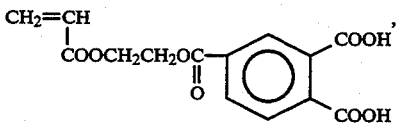

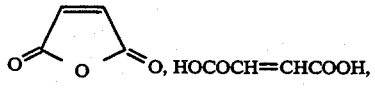

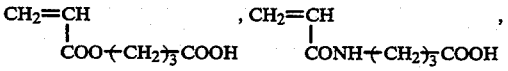

-continued

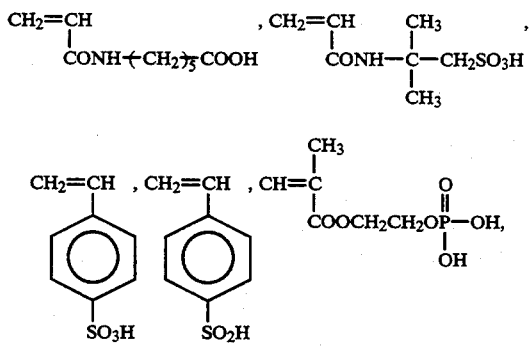

or the salts thereof (for example, Na and K salts and an ammonium salt); and the monomers having a cationic group, such as tertiary amines and the salts thereof (for example, hydrochloride, sulfate and acetate) including N,N-diethylaminoethyl methacrylate, N,N-dimethylaminoethyl acrylate, N,N-diethylaminoethyl acrylate, N-(N,N-dimethylaminopropyl) acrylamide, N-(N,N-dihexylaminomethyl) acrylamide, 3-(4-pyridyl)-propyl acrylate, and N,N-diethylaminomethylstyrene, and the quaternary ammonium compounds including N,N,N-trimethyl-N-vinylbenzylammonium chloride and N,N,N-trimethyl-N-(3-acrylamidepropyl)ammonium chloride. Of them, the non-ionic monomers and the monomers having an anionic functional group are particularly preferred.

In the polymer having a repetitive unit represented by Formula (A), the other ethylenically un-saturated monomers can be copolymerized therewith as long as the water solubility thereof is not adversely affected. There can be enumerated as such monomers, for example, ethylene, propylene, 1-butene, isobutene, α-methylstyrene, vinyl ketone, fatty acid monoethylenically unsaturated esters (for example, vinyl acetate and allyl acetate), ethylenically unsaturated monocarboxylic acids or dicarboxylic acid esters (for example, methyl methacrylate, ethyl methacrylate, n-butyl methacrylate, n-hexyl methacrylate, cyclohexyl methacrylate, benzyl methacrylate, n-butyl acrylate, n-hexyl acrylate, and 2-ethylhexyl acrylate), monoethylenically unsaturated compounds (for example acrylonitrile), and dienes (for example, butadiene and isoprene).

In the polymer having a repetitive unit represented by Formula (A) according to the present invention, the ratio of the monomer containing a thioether group to other monomers may vary widely according to the monomer structure and the intended use and generally falls within the range of 0.1 to 100 weight %, particularly preferably 1 to 70 weight %.

The molecular weight of the polymer having a repetitive unit represented by Formula (A) is preferably from $3\times10^3$ to $1\times10^6$, more preferably from $5\times10^3$ to $2\times10^5$.

Specific examples of the polymer having a repetitive unit represented by Formula (A) according to the present invention will be given below but the present invention is not limited thereto:

P-1 : 3-thiapentyl acrylate/sodium 2-acrylamide-2-methylpropanesulfonate copolymer (1/1 mole ratio).

P-2: 3-thiapentyl acrylate/sodium 2-acrylamide-2-methylpropanesulfonate copolymer (½ mole ratio).

P-3: 3-thiapentyl acrylate/sodium 2-acrylamide-2-methylpropanesulfonate copolymer (⅓ mole ratio).

P-4: 3-thiapentyl acrylate/sodium 2-acrylamide-2-methylpropanesulfonate copolymer (1/4.5 mole ratio).

P-5 : 3-thiapentyl acrylate/sodium 2-acrylamide-2-methylpropanesulfonate copolymer (1/6 mole ratio).

P-6 : 3-thiapentyl acrylate/sodium 2-acrylamide-2-methylpropanesulfonate copolymer (1/9 mole ratio).

P-7: 3-thiapentyl methacrylate/sodium 2-acrylamide-2-methylpropanesulfonate copolymer (1/1 mole ratio).

P-8: 3-thiapentyl methacrylate/sodium 2-acrylamide-2-methylpropanesulfonate copolymer (1/6 mole ratio).

P-9 : 3-thiabutylacrylamide/sodium 2-acrylamide-2-methylpropanesulfonate copolymer (1/6 mole ratio).

P-10: 3-thiapentyl acrylate/acrylic acid/sodium acrylate copolymer (1/3/3 mole ratio).

P-11: 3-thiapentyl acrylate/acrylamide copolymer (1/12.5 mole ratio).

P-12: N-(3-thiapentyl)acrylamide/acrylamide/sodium acrylate copolymer (1/1/2 mole ratio).

P-13: 2-thiabutyl acrylate/methyl methacrylate/sodium 2-acrylamide-2-methylpropanesulfonate copolymer (1/1/5 mole ratio).

P-14: N-(3-thiabutyl)acrylamide/sodium acrylate/-sodium styrenesulfonate copolymer (1/4/4 mole ratio).

P-15: 3-thiapentyl acrylate/methyl acrylate/N,N-dimethylaminopropylmethacrylamide sulfate copolymer (1/3/4 mole ratio).

P-16: 3-thiapentyl-4-vinylbenzoate/N,N-dimethylaminostyrene sulfate copolymer (1/5 mole ratio).

P-17: sodium N-acryloylmethionine/methyl methacrylate/sodium 2-acrylamide-2-methylpropanesulfonate copolymer (1/5/5 mole ratio).

P-18: N-acryloylmethionine methyl ester/sodium 2-acrylamide-2-methylpropanesulfonate copolymer (1/6 mole ratio).

P-19: N-(3,6-dithiaheptyl)acrylamide/acrylamide/-sodium 2-acrylamide-2-methylpropanesulfonate copolymer (1/5/6 mole ratio).

P-20: N-[2,2-bis(1-thiapropyl)ethyl]acrylamide/N-vinylpyrrolidone/sodium 2-acrylamide-2-methylpropanesulfonate copolymer (1/0.25/8 mole ratio).

The above monomers having a thioether structure and polymers are described in, for example, U.S. Pat. Nos. 3,536,677, 3,615,624, 3,679,425, 3,692,753, and 3,706,564, and Research Disclosure, vol. 104, pp. 44 to 48 (1972), and they can be synthesized according to these publications.

The polymers according to the present invention can be prepared by various polymerizing methods, for example, a solution polymerization, a precipitation polymerization, a suspension polymerization, and a block polymerization. There are available as the method for initiating the polymerization, the method in which a radical initiator is used, the method in which a radial ray is irradiated, and a heat polymerization method. These polymerizing methods and the methods for initiating the polymerization are described in, for example, "*High Molecular Synthetic Reaction*" written by T. Tsuruta, revised edition (published by Daily Industry News Paper, 1971).

Of the above polymerizing methods, the solution polymerization method in which a radical initiator is used is particularly preferred. There may be used as the solvent used for the solution polymerization method, water or an organic solvent such as, for example, ethyl acetate, methanol, ethanol, 1-propanol, 2-propanol, acetone, dioxane, N,N-dimethylformamide, N,N-dimethyl-acetoamide, toluene, n-hexane, and acetonitrile. They may be used singly or in mixtures of two or more kinds, and a mixed solvent with water may be used as well.

The polymerizing temperature is required to be chosen in relation to the molecular weight of the polymer prepared and the kind of the initiator and it is chosen over the range from 0° C. or lower to 100° C. or higher. Usually, the polymerization is carried out in the range of 30° to 100° C.

Preferred as the radical initiator used for the polymerization are an azo series initiator such as 2,2'-azobisisobutylonitrile, 2,2'-azobis(2,4-dimethylvaleronitrile), 2,2'-azobis(2-amidinopropane)dihydrochloride, and 4,4'-azobis(4-cyano-pentanoic acid), and a peroxide series initiator such as benzoyl peroxide and potassium persulfate.

The amount of the initiator is adjusted according to the molecular weight of the polymer and is preferably in the range of 0.01 to 10 mole, particularly preferably 0.01 to 1.0 mole per 100 mole of the monomer.

When the polymer according to the present invention is synthesized in the form of a copolymer, all the monomers to be used may first be put in a reaction vessel and then an initiator may be added thereto to start a polymerization, but the polymer of the invention is preferably synthesized through a process in which the monomers are dropped to a polymerization medium. The ethylenically unsaturated monomers to be dropped may be dropped either in a mixture of all the monomers of two or more kinds to be used, or they may be dropped independently. The ethylenically unsaturated monomers may be dissolved in a suitable auxiliary solvent in dropping. There may be used as the auxiliary solvent, water or an organic solvent (for example, methanol, ethanol, acetone, and ethyl acetate), or a mixed solvent of water and an organic solvent.

The time needed for dropping is varied according to the polymerization reactivity of the ethylenically unsaturated monomers. It is preferably 5 minutes to 8 hours, particularly preferably 30 minutes to 4 hours. The dropping speed may be either constant within the dropping or may suitably be changed during the dropping time. When the ethylenically unsaturated monomers are dropped independently, the total dropping time and dropping speed of each monomer can freely be changed according to necessity. In particular, when there exists a large difference between the polymerization reactivities of the respective ethylenically unsaturated monomers, a method in which the monomers having the higher reactivities are slowly dropped is preferred.

The polymerization initiator may be added in advance to a polymerization solvent or may be added simultaneously with the ethylenically unsaturated monomers. It may be dissolved in a solvent to be dropped independently from the ethylenically unsaturated monomers. Two or more kinds of such addition methods may be combined.

The temperature for dropping the ethylenically unsaturated monomers is not limited as long as it falls within the range in which the polymerization can take place. The polymerization temperature is varied according to the kind of the initiator and the kinds of the ethylenically unsaturated monomers. Usually, it falls within the range of 20° to 100° C., preferably 30° to 100° C., and particularly preferably 40° to 95° C.

The polymer containing at least one thioether structure on a side chain of the present invention may be used in combination with the polymer containing thioether structure mentioned below.

There can be enumerated as the polymer containing thioether structure, the polymers obtained by carrying out a radical polymerization in the presence of mercaptans as described in JP-A-54-145522.

In this process, the thioether structure is formed at terminal of the polymer by a chain transfer reaction of a polymer radical to mercaptans, the initiation of a polymerization from an S radical formed and the repetition of a continuation as described at pages 10 to 30 of "Oligomer" edited by S. Ohkawara (Kohdansha Scientific, 1976).

Suitable mercaptans for use in the process include n-butyl mercaptan, n-hexyl mercaptan, n-octyl mercaptan, n-dodecyl mercaptan, 2-mercaptoethanol, 2-mercaptoethyl-amine, thiosalicylic acid, benzenethiol, thioglycolic acid, N-(2-mercaptoethyl)-cyclohexylamine, (2-mercaptoethyl)-trimethylammonium bromide or the corresponding acetate, 2-mercaptoaniline, 3-mercaptoaniline, 4-mercaptoaniline, mercaptoanisole, 2-mercaptobenzimidazole, 2-mercaptobenzothiazole, 2-mercaptobenzo-oxazole, 2-mercapro-4-(3H)-quinazolinone, 2-mercapto-quinoline, ethylmercaptoacetate, methylmercaptoacetate, 2-mercapro-1-methylimidazole, 2-mercapro-4-methyl-pyridine, 1-mercapro-3-phenylpropane, and 5-mercapto-1-phenyl-1,2,3,4-tetrazole.

The preferred monomers used for a polymerization reaction are such that the homopolymers thereof are soluble in water, an aqueous acid solution or an aqueous alkali solution, which have been described previously.

The monomers having a thioether group or the other ethylenically unsaturated monomers may be copolymerized therewith according to necessity.

Specific examples of such polymer compounds will be shown below in terms of the mercaptans used and the mole ratios of the monomers.

Q-1: mercaptoethanol/acrylamide/sodium 2-acrylamide-2-methylpropanesulfonate (1/500/10).

Q-2: mercaptoethanol/acrylamide/sodium 2-acrylamide-2-methylpropanesulfonate (1/100/5).

Q-3: hexylmercaptan/acrylamide/sodium 2-acrylamide-2-methylpropanesulfonate (1/100/5).

Q-4: ethyl thioglycolate/methyl methacrylate/sodium 2-acrylamide-2-methylpropanesulfonate (1/50/100).

Q-5: mercaptoethanol/acrylamide (1/1000).

Q-6: octylmercaptan/methyl methacrylate/acrylic acid/sodium acrylate (1/50/100/100).

Q-7: bismercaptoethylsulfide/acrylamide (1/1200).

Q-8: bismercaptoethylsulfide/acrylic acid/sodium acrylate (1/100/100).

Q-9: mercaptoethanol/3-thiapentyl acrylate/sodium 2-acrylamide-2-methylpropanesulfonate (1/15/100).

Q-10: n-butyl thioglycolate/3-thiapentyl acrylate/2-acrylamide-2-methylpropanesulfonate (1/10/100).

The polymers obtained by carrying out the radical polymerization in the presence of the above mercaptans can be prepared according to the method described in, for example, JP-A-54-145522. They can be prepared in basically the same manner as in a conventional radical polymerization except that mercaptans are used in addition to the ethylenically unsaturated monomers.

Accordingly, these polymers can be manufactured according to the method for preparing the polymer having a repetitive unit represented by the above Formula (A).

The deflocculating agent according to the present invention is used in forming the silver halide grains. It can be used by dissolving it in advance in a halide solution or silver salt solution used for forming the silver halide grains, by adding in advance to a reaction vessel a solution in which the deflocculating agent is dissolved, or by adding the deflocculating agent solution together with the silver salt solution. The deflocculating agent is preferably added in advance to the reaction vessel in the form of an aqueous solution. The addition amount thereof is 0.1 to 150 g, preferably 0.5 to 80 g per mole of silver halide.

Next, the polymer having a repetitive unit represented by Formula (I) will be explained in detail.

The polymer according to the present invention is a polymer having a repetitive unit represented by Formula (I). Of the repetitive units represented by Formula (I), the preferred units are units in which $R^1$ represents a hydrogen atom and Q represents one of the following (i) to (iii):

(i) in the above Formula (1), q is 2 or 3 (to be specific, the group represented by the following Formula (10));

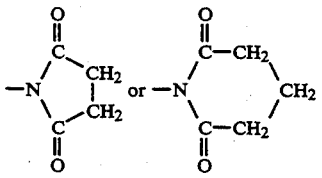

(10)

(ii) in the above Formula (2), $R^2$ is methyl or ethyl and $R^3$ is a hydrogen atom, methyl, or ethyl;

(iii) in the above Formula (3), A is a single bond or a —C(=O)— group and $Z^1$ forms a 5- or 6-membered lactam ring or oxazolidone ring.

Particularly preferred is the case in which Q is a group represented by the following Formula (11), a pyrrolidone group, or an oxazolidone group. Of them, the case in which Q is a pyrrolidone group is most preferred:

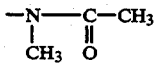

(11)

The polymer having a repetitive unit represented by Formula (I) may be not only a homopolymer but also a copolymer. That is, it may be a polymer obtained by the homopolymerization of a monomer represented by the following Formula (IA), it may be a copolymerization product of two or more monomers, or it may be a copolymerization product made with other ethylenically unsaturated compounds capable of addition polymerizing therewith:

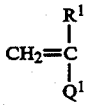

(IA)

wherein $R^1$ has the same meaning as in Formula (I) and $Q^1$ represents any one of the groups represented by the following Formulas (a) to (d):

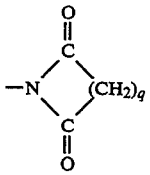

(a)

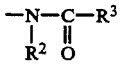

(b)

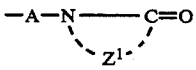

(c)

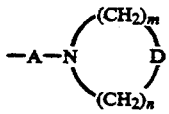

(d)

In Formulas (a) to (d), q, $R^2$, $R^3$, A, $Z^1$, D, m, and n have the same meanings as in Formula (I).

Specific examples of monomers represented by Formula (IA) include, for example, N-vinylsuccinimide, N-vinylglutarimide, N-vinyladipimide, N-vinylacetoamide, N-methyl-N-vinylformamide, N-methyl-N-vinylacetoamide, N-ethyl-N-vinylacetoamide, N-methyl-N-vinylpropioneamide, N-vinyl-pyrrolidone, N-vinyl-piperidone, N-vinyl-ε-caprolactam, N-vinyloxazolidone, N-acryloylpyrrolidone, N-acryloyloxyethylpyrrolidone, N-acryloylmorpholine, N-acryloylpiperidine, N-methacryloylmorpholine, N-(β-morpholinoethylacrylamide, N-vinylmorpholine, and N-vinyl-2-pyridone. Of them, preferred are, for example, N-vinylsuccinimide, N-vinylglutarimide, N-methyl-N-vinylacetoamide, N-ethyl-N-vinylacetoamide, N-vinylpyrrolidone, N-vinyl-piperidone, and N-vinyloxazolidone. Particularly preferred are N-methyl-N-vinylacetoamide, N-vinylpyrrolidone, and N-vinyloxazolidone.

Examples of addition-polymerizable ethylenically unsaturated compound which form copolymers together with a monomer of Formula (IA) include, for example, acrylic acid esters, methacrylic acid esters, acrylamides, methacrylamides, allyl compounds, vinyl ethers, vinyl esters, vinyl heterocyclic compounds, styrenes, maleic acid esters, fumaric acid esters, itaconic acid esters, crotonic acid esters, and olefins. Specific examples thereof include, methyl acrylate, ethyl acrylate, isopropyl acrylate, n-butyl acrylate, octyl acrylate, 2-chloroethyl acrylate, 2-cyanoethyl acrylate, N-(β-dimethylaminoethyl) acrylate, benzyl acrylate, cyclohexyl acrylate, and phenyl acrylate; methyl methacrylate, n-propyl methacrylate, isopropyl methacrylate, n-butyl methacrylate, cyclohexyl methacrylate, and 3-sulfopropyl methacrylate; allyl butyl ether, and allyl phenyl ether; methyl vinyl ether, butyl vinyl ether, methoxyethyl vinyl ether, 2-hydroxyethyl vinyl ether, (2-dimethylaminoethyl) vinyl ether, vinyl phenyl ether, vinyl chlorophenyl ether, acrylamide, methacrylamide, N-methylacrylamide, N-(1,1-dimethyl-3-oxobutyl) acrylamide, N-(1,1-dimethyl-3-hydroxybutyl) acrylamide, N,N-dimethyacrylamide, acryloyl hydrazine, N-methoxymethyl methacrylamide, N-(1,1-dimethyl-3-hydroxybutyl) methacrylamide, and N-hydroxymethylacrylamide; vinylpyridine, N-vinylimidazole, N-vinylcarbazole, and vinylthiophene; styrene, chloromethylstyrene, p-acetoxystyrene, and p-methylstyrene; p-vinylbenzoic acid, and methyl p-vinyl-benzoate; crotonic acid amide, butyl crotonate, and glycerine monocrotonate; methyl vinyl ketone, and phenyl vinyl ketone; ethylene, propylene, 1-butene, dicyclo-pentadiene, 4-methyl-1-hexene, 4,4-dimethyl-1-pentene; methyl itaconate, ethyl itaconate, and diethyl itaconate; methyl sorbate, ethyl maleate, butyl maleate, dibutyl maleate, and octyl maleate; ethyl fumarate, dibutyl fumarate, and octyl fumarate; halogenated olefins, for example, vinyl chloride, vinylidene chloride, and isoprene; unsaturated nitriles, for example, acrylonitriles and methacrylonitriles. Two or more kinds thereof can be used according to necessity. Of them, preferred from the viewpoint of the hydrophilicity of the polymer prepared are acrylic acid, metha-acrylic acid, 2-hydroxyethyl acrylate, 2-methoxyethyl acrylate, sulfopropyl acrylate, acrylamide, dimethyl-acrylamide, 2-acryloylamino-2-methylpropanesulfonic acid, hydroxyethylacrylamide, methacrylamide, methyl vinyl ether, sodium styrenesulfonate, N-vinyl-3,5-dimethyltriazole, and maleic anhydride.

The composition ratio of the polymer having a repetitive unit represented by Formula (I) is not specifically limited. The ratio of the component represented by Formula (I) is preferably 10 to 100 mole %, particularly preferably 50 to 100 mole %.

These polymers or copolymers having a repetitive unit represented by Formula (I) can be synthesized with reference to the methods described in British Patent No. 1,211,039, JP-B-47-29195, JP-A-48-76593, 48-92022, 49-21134, and 49-120634, British Patent No. 961,395, U.S. Pat. Nos. 3,227,672, 3,290,417, 3,262,919, 3,245,932, 2,681,897, and 3,230,275, "*Official Digest*" written by John C. Petropoulous et al, vol. 33, pp. 719 to 736 (1961), and "*Synthetic High Molecule*" edited by S. Murahashi et al, vol. 1, pp. 246 to 290 and vol. 3, pp. 1 to 108. It is a matter of course that the polymerization initiator, the reactant concentrations, the polymerization temperature, and the reaction time can widely and readily be changed.

For example, the polymerization is generally carried out with a radical polymerization initiator of 0.05 to 5 weight % based on a monomer which is usually to be polymerized at 20° to 180° C., preferably 40° to 120° C. Examples of initiators include azobis compounds, peroxides, hydroperoxides, and redox catalysts, for example, potassium persulfate, tert-butyl peroctoate, benzoyl peroxide, azobisisobutyronitrile, 2,2'-azobiscyanvaleric acid, and 2,2'-azobis-(2-amidino-propane hydrochlorate).

The molecular weight of the above polymer used in the present invention is usually about 2,000 or more, preferably from 8000 to 700,000. However, these values are not critical for obtaining the effects of the present invention.

Specific examples of representative polymers having a repetitive unit represented by Formula (I) used in the present invention are given below:

(1) poly(N-vinylpyrrolidone)
(2) poly(N-vinyloxazolidone)
(3) poly(N-vinylsuccinimide)
(4) poly(N-vinylglutarimide)
(5) poly(N-vinylpiperidone)
(6) poly(N-vinyl-ε-caprolactam)
(7) poly(N-methyl-N-vinylacetoamide)
(8) poly(N-ethyl-N-vinylacetoamide)
(9) poly(N-vinylacetoamide)
(10) vinyl alcohol/N-vinylacetoamide copolymer (mole ratio 30:70)
(11) vinyl alcohol/N-vinylpyrrolidone copolymer (mole ratio 20:80)
(12) vinyl alcohol/N-vinylpyrrolidone copolymer (mole ratio 30:70)
(13) N-vinylpyrrolidone/vinylacetate copolymer (mole ratio 70:30)
(14) N-vinylpyrrolidone/2-hydroxyethyl acrylate copolymer (mole ratio 70:30)
(15) N-vinylpyrrolidone/acrylic acid copolymer (mole ratio 90:10)
(16) N-vinylpyrrolidone/N-vinyl-3,5-dimethyltriazole co-polymer (mole ratio 50:50)
(17) N-vinylpiperidone/2-methoxyethyl acrylate copolymer (mole ratio 70:30)
(18) N-vinylpiperidone/methyl vinyl ether copolymer (mole ratio 90:10)
(19) N-vinyloxazolidone/vinyl alcohol copolymer (mole ratio 65:35)
(20) N-vinyloxazolidone/acrylic acid copolymer (mole ratio 80:20)
(21) N-vinylpyrrolidone/N-vinylpiperidone/2-hydroxyethyl acrylate copolymer (mole ratio 40:30:30)
(22) vinyl alcohol/vinylacetate/N-vinyl-2-pyridone copolymer (mole ratio 70:25:5)
(23) N-vinylpyrrolidone/2-hydroxyethyl acrylate/vinylacetate copolymer (mole ratio 70:20:10)
(24) N-vinylpyrrolidone/vinyl alcohol/vinylpropionate/sodium styrenesulfonate copolymer (mole ratio 40:40:5:15)
(25) N-vinylpyrrolidone/acrylamide copolymer (mole ratio 60:40)
(26) N-vinylpyrrolidone/2-acrylamide-2-methylpropanesulfonic acid copolymer (mole ratio 75:25)
(27) N-vinylpiperidone/acrylamide copolymer (mole ratio 60:40)
(28) N-vinyloxazolidone/N-(2-hydroxyethyl)acrylamide copolymer (mole ratio 70:30)
(29) N-vinylpyrrolidone/vinylmorpholine/acrylamide copolymer (mole ratio 50:20:30)
(30) N-vinylsuccinimide/N-vinyl-E-caprolactam/acrylamide copolymer (mole ratio 40:20:40)
(31) N-vinyloxazolidone/acrylamide/acrylic acid copolymer (mole ratio 60:20:20)
(32) N-vinylpyrrolidone/acrylamide/vinylacetate/acrylic acid copolymer (mole ratio 60:20:10:10)
(33) N-vinylpyrrolidone/dimethylacrylamide copolymer (mole ratio 70:30)

The present invention is applied to an internal latent image type direct positive silver halide emulsion.

An internal latent image type direct positive silver halide emulsion (hereinafter referred to as an internal latent image type silver halide emulsion) means a silver halide emulsion in which a latent image is formed primarily in the insides of the silver halide grains when they are subjected to imagewise exposure. To be specific, it is defined as a silver halide emulsion, which is coated on a transparent support in a fixed amount, in which the maximum density obtained by subjecting it to an exposure for a fixed time of 0.01 to 1 second and then to a development in the following developing solution A (an internal type developing solution) at 20° C. for five minutes is at least five times as large as the maximum density obtained by developing a second sample exposed in the same manner as above in the following developing solution B (a surface type developing solution) at 20° C. for five minutes, wherein the maximum density is measured by a conventional photographic density measuring method:

| | |
|---|---|
| Developing solution A | |
| N-methyl-p-aminophenol sulfite | 2 g |
| Sodium sulfite (anhydrous) | 90 g |
| Hydroquinone | 8 g |
| Sodium carbonate (monohydrate) | 52.5 g |
| Potassium bromide | 5 g |
| Potassium iodide | 0.5 g |
| Water was added to | 1 liter |
| Developing solution B | |
| N-methyl-p-aminophenol sulfite | 2.5 g |
| 1-Ascorbic acid | 10 g |
| Potassium metaborate | 35 g |
| Potassium bromide | 1 g |
| Water was added to | 1 liter |

Examples of internal latent image type silver halide emulsions include the conversion type silver halide emulsions described in, for example, U.S. Pat. Nos. 2,456,953 and 2,592,250, the lamination structure type silver halide emulsions in which the halogen compositions in the first layer and second layer are different, described in U.S. Pat. No. 3,935,014, and the core/shell type silver halide emulsions in which a metal ion is doped or a shell is coated on a core subjected to a chemical sensitization. Of them, the core/shell type silver halide emulsion is preferred for the internal latent image type silver halide emulsion used in the present invention. Examples of core/shell type emulsions are described in U.S. Pat. Nos. 3,206,313, 3,317,322, 3,761,266, 3,761,276, 3,850,637, 3,923,513, 4,035,185, 4,184,878, 4,395,478, and 4,504,570, and JP-A-57-136641, 61-3137, 63-151618, and 1-131547.

A direct positive image can be obtained by subjecting the above internal latent image type silver halide emulsion to an imagewise exposure and then the subjecting whole surface of a light-sensitive layer to an even second exposure before or during a development processing ("an optical fogging method" described in, for example, British Patent No. 1,151,363), or by carrying out the development processing under the presence of a nucleating agent ("a chemical fogging method" described in, for example, Research Disclosure, vol. 151, No. 15162, pp. 76 to 78). In the present invention, the method is preferred in which a direct positive image is obtained by a chemical fogging method. The nucleating agent used in the present invention will be described later.

Examples of nucleating agents include the hydrazines described in U.S. Pat. Nos. 2,563,785 and 2,588,982, the hydrazides and hydrazones described in U.S. Pat. No. 3,227,552, the heterocyclic quaternary salt compounds described in British Patent No. 1,283,835, JP-A-52-69613, 55-138742, 60-11837, 62-210451, and 62-291637, and U.S Pat. Nos. 3,615,615, 3,719,494, 3,734,738, 4,094,683, 4,115,122, 4,306,016, and 4,471,044, the sensitizing dyes having a substituent with a nucleus-forming function in a dye molecule, described in U.S. Pat. No. 3,718,470, the thiourea bonding type acyl-hydrazine series compounds described in U.S. Pat. Nos. 4,030,925, 4,031,127, 4,245,037, 4,255,511, 4,266,013, and 4,276,364, and British Patent No. 2,012,443, and the acylhydrazine series compounds to which a thioamide ring and a heterocyclic group such as triazole and tetrazole are bonded as an adsorbing group, described in U.S. Pat. Nos. 4,080,270 and 4,278,748, and British Patent No. 2,011,391B.

The amount of the nucleating agent used herein is preferably such an amount which will give a sufficient maximum density when the internal latent image type emulsion is developed in a surface developing solution. From a practical standpoint, the amount differs according to the characteristics of the silver halide emulsion used, the chemical structure of the nucleating agent, and the developing conditions, and therefore the suitable content thereof can be changed over a wide range. In practical terms, the nucleating agent is useful in the amount of 0.1 mg to 5 g, preferably about 0.5 mg to about 2 g per mole of silver contained in the internal latent image type silver halide emulsion. Where it is incorporated into a hydrophilic colloid layer adjacent to an emulsion layer, the same amount as that mentioned above may be added based on the amount of silver contained in the internal latent image type emulsion in the adjacent emulsion layer.

Silver halide grains of various forms can be used in the present invention. Examples thereof include the grains having a regular crystal form such as cubic, octahedral, tetradecahedral, and rhombic dodecahedral, grains having an irregular crystal form such as spherical and plate-like, grains having a higher face (hkl), and mixtures of grains of these crystal forms. The grains having the higher face are described in the *Journal of Imaging Science*, vol. 30 (1986), pp. 247 to 254.

The silver halide grains used in the present invention can be selected from a regular crystal containing no twinned face, and the examples described at pp. 163 of "Ground in a Photographic Industry", Chapter "Silver Salt Photography" (Corona Co.), for example, a singlet twinned crystal containing one twinned face, a parallel multiplet twinned crystal containing two or more parallel twinned faces, and a non-parallel multiplet twinned crystal containing two or more non-parallel twinned faces, according to the purposes.

Further, an example in which grains having different forms are mixed is disclosed in U.S. Pat. No. 4,865,964, and this method can be selected according to necessity.

In case of the regular crystal forms, there can be used cubic grains consisting of a (100) face, octahedralgrains consisting of a (111) face as and dodecahedron consisting of a (110) face disclosed in JP-B-55-42737 and JP-A-60-222842. Further, though the preparing methods thereof have to be contrived, there can be selected and used according to the purposes, the (hll) face grains represented by a (211) face, the (hhl) face grains represented by a (331) face, the (hk0) face grains represented by a (210) face, and the (hkl) face grains represented by a (321) face, as reported in Journal of Imaging Science, vol. 30, pp. 247 (1986).

There can be selected and used according to the purposes, grains in which two or more faces coexist, such as tetradecahedral grains in which a (110) face and a (111) face coexist in one grain, grains in which a (100) face and a (110) face coexist, or grains in which a (111) face and a (110) face coexist.

There may be used as a silver halide composition for these grains, any silver halide selected from silver bromide, silver bromoiodide, silver bromochloroiodide, silver bromochloride, silver chloroiodide, and silver chloride. Of these, silver bromide and silver bromoiodide are preferred. Further, in addition to the above silver salts, these grains or other grains may contain other silver salts, for example, silver thiocyanate, silver cyanate, silver sulfide, silver selenide, silver carbonate, silver phosphate, and silver organic acid. The silver halide grains may have different phases in an inside and a surface layer, or may consist of a single phase. The silver halide composition in the grains may be the same or different in the inside and surface layer, or may be of a layer structure (JP-A-57-154232, 58-108533, 58-248469, 59-48755, and 59-52237, U.S. Pat. Nos. 3,505,068, 4,433,048, and 4,444,877, European Patent No. 100,984, and British Patent No. 1,027,146). Further, grains having a dislocation line can be used as well.

In case of silver halide grains in which two or more silver halides are present as a mixed crystal or with a structure, it is important to control the halide composition distribution between the grains. A method for measuring the halide composition distribution between grains is described in JP-A-60-254032. A even halogen distribution between the grains is a desirable characteristic. In particular, a highly even emulsion having a variation coefficient of 20 % or less is preferred. Another preferred embodiment is an emulsion in which a correlation is present between the grain size and the silver halide composition.

It is important to control the halogen composition in the vicinity of the grain surface. An increase in the silver iodide content or silver chloride content in the surface vicinity leads to a change in the adsorbability of dyes and in the developing speed and therefore the halogen composition can be selected according to the purposes. Where the halogen composition in the surface vicinity is changed, there can be selected either a structure in which a whole grain is covered or a structure in which only a part of the grain is covered. There is involved, for example, the case in which only one face of a tetradecahedral grain consisting of a (100) face and a (111) face has a different halogen composition or either a side face or a primary face in a tabular grain has a different halogen composition.

The grain size of the emulsion used in the present invention can be evaluated in terms of the circle-corresponding diameter of the projected area with an electron microscope, the sphere-corresponding diameter of the grain volume calculated from the projected area and the grain thickness, or the sphere-corresponding diameter of a volume by a colter counter method. It can be used by selecting from a super fine grain of 0.05 μm or less to a coarse grain exceeding 10 μm in terms of the sphere-corresponding diameter. Grain diameters of 0.1 μm or more and 3 μm or less are preferred.

The grain size distribution of the silver halide grains is arbitrary and may be a monodispersion, wherein a monodispersion is defined as a dispersion system in which 95% of the grains based on the entire weight or entire number of silver halide grains contained therein falls within ±60% or less, preferably 40% or less of the number average grain size, wherein the number average grain size is the number average diameter of the circles corresponding to the projected areas of the silver halide grains.

Monodispersed emulsions are described in U.S. Pat. Nos. 3,574,628 and 3,655,394, and British Patent No. 1,413,748, and these monodispersed emulsions may be used in a mixture.

It is possible to use in combination two or more kinds of these silver halides having different crystal habits, halogen compositions, grain sizes, and grain size distributions and to use them for different emulsion layers and/or the same layer.

In the present invention, the tabular silver halide grains can be used. The manufacturing methods and application techniques of tabular silver halide grains are described in *Photography Theory and Practice* written by Cleve (1930) pp. 131; *Photographic Science and Engineering* written by Gutoff, vol. 14, pp. 248 to 257 (1970); U.S. Pat. Nos. 4,434,226, 4,414,310, 4,433,048, 4,439,520, 4,414,306, and 4,459,353, British Patent No. 2,112,157, and JP-A-59-99433 and 62-209445. In particular, tabular internal latent image type direct positive silver halide emulsions are described in detail in U.S. Pat. Nos. 4,395,478, 4,504,570, and 4,996,137, JP-B-64-8327, and JP-A-1-131547. These tabular internal latent image type direct positive silver halide emulsions are excellent in terms of providing a direct positive image having good sharpness, rapid developing speed and small temperature dependency.

The form of the tabular grains can be selected from a triangle, a hexagon and a circle. The regular triangle having six sides of almost equal lengths described in U.S. Pat. No. 4,996,137 is a preferred form.

In case of tabular grains, a dislocation line can be observed with a transmission type electron microscope. Grains containing no dislocation lines at all, grains containing several dislocation lines, or grains containing numerous dislocation lines can be selected according to the purposes. Further, a dislocation line introduced linearly to a specific direction in the crystal orientation of the grain, or a curved dislocation line can be selected as well. It is also possible to select from a dislocation line introduced over the whole grain, or a dislocation line introduced only into a specific part of the grain, for example, a dislocation line introduced with limitation to the fringe site of the grain. A dislocation line can be introduced not only into tabular grains but also into regular crystal grains or irregular grains represented by potato-shaped grains.

Tabular silver halide grains into which a dislocation is intentionally introduced are disclosed in, for example, JP-A63-220238 and 1-201649.

The preferred ratio of the average grain diameter to the average grain thickness (hereinafter referred to as the grain diameter/thickness) in the tabular grains is 2 or more, preferably 3 to 12, and particularly preferably 5 to 8, wherein the average grain diameter in the tabular silver halide grains is represented by the average value of the circle-corresponding diameters of two opposite parallel or almost parallel primary planes (the diameters of the circles having the same area as the projected area of the primary planes), and the average grain thickness is represented by the average value of the distances between the primary planes.

The grain diameter/thickness can be obtained by averaging the grain diameter/thickness of all the grains. It can also be obtained in a simple manner in terms of the ratio of the average diameter of all the tabular grains to the average thickness of all the tabular grains.

The average grain diameter (circle-corresponding) of the tabular grains is 0.3 μm or more, preferably 0.3 to 10 μm, more preferably 0.5 to 5.0 μm, and further more preferably 0.5 to 3.0 μm.

The average grain thickness is less than 1.0 μm, preferably 0.05 to 0.5 μm.

A highly even thickness emulsion having a variation coefficient of 30% or less in the grain thickness is preferred as well. Further, it is preferred to use grains in which the grain thickness and the distance between the twinned planes are regulated, as described in JP-A-63-163451. In the present invention, the above tabular grains account for 50% or more, preferably 70% or more, and more preferably 90% or more of the projected area based on all the grains in the emulsion containing them.

The grain diameter and grain thickness of the tabular grains can be measured with electron microscope photographs of the grains according to the method described in U.S. Pat. No. 4,434,226.

Further, in the present invention, the tabular grains are preferably monodispersed. The structure and method of preparing the monodispersed tabular grains are described in, for example, JP-A-63-151618.

The silver halide emulsion used in the present invention may be subjected to a treatment for providing the grains with a roundness as disclosed in European Patents Nos. 96,727B1 and 64,412B1, or a surface modification as disclosed in German Patent No. 2,306,447C2 and JP-A-60-221320.

In general, the grains have surfaces of a flat constitution but it is preferred in some cases that a roughness be intentionally formed thereon. Examples thereof are the method in which a hole is made at a part of the crystal, for example, a peak or the center of a plane, as described in JP-A58-106532 and 60-221320, and the ruffled grains described in U.S. Pat. No. 4,643,966.

The silver halide grains used in the present invention can be prepared by using the methods described in Research Disclosure (RD) No. 17643 (December 1978), pp. 22 to 23, "I. Emulsion preparation and types", No. 18716 (November 1979), pp. 648, and No. 307105 (November 1989), pp. 863 to 865; *Chimie et Physique Photographique* written by P. Glafkides, published by Paul Montel Co., Ltd. (1967); *Photographic Emulsion Chemistry* written by G. F. Duffin, published by The Focal Press Co., Ltd. (1966); and *Making and Coating Photographic Emulsion* written by V. L. Zelikman et al, published by The Focal Press Co., Ltd. (1964). That is, any of an acid method, a neutral method and an ammonia method may be used, and there may be used as the manner for reacting a soluble silver salt with a soluble halide, any of a single mixing method, a double jet method and combinations thereof. There can be used a method of forming the silver halide grains in the presence of excessive silver ions (a so-called reverse mixing method). There can also be used as one form of the double jet method, a method in which the pAg of a solution in which silver halide is prepared is maintained at a fixed level, that is, a controlled double jet method. A silver halide emulsion consisting of silver halide grains with a regular crystal form and an almost uniform grain size can be obtained with this method.

Tabular grains can readily be prepared according to the methods described in *Photographic Science and Engineering* written by Gutoff, vol. 14, pp. 248 to 257 (1970); U.S. Pat. Nos. 4,434,226, 4,414,310, 4,433,048, and 4,439,520, and British Patent No. 2,112,157.

The silver halide emulsion consisting of the above regular grains can be obtained by controlling the pAg and pH during grain formation. To be specific, it is described in, for example, *Photographic Science and Engineering*, vol. 6, pp. 159 to 165 (1962); *Journal of Photographic Science*, vol. 12, pp. 242 to 251 (1964), U.S. Pat. No. 3,655,394, and British Patent No. 1,413,748.

Monodispersed emulsions are described in JP-A-48-8600, 51-39027, 51-83097, 53-137133, 54-48521, 54-99419, 58-37635, and 58-49938, JP-B-47-11386, U.S. Pat. No. 3,655,394, and British Patent No. 1,413,748.

Preferred in some cases is a method in which silver halide grains for preparing an emulsion are precipitated and formed beforehand in a reaction vessel, before being added to the emulsion, as described in U.S. Pat. Nos. 4,334,012, 4,301,241, and 4,150,994. These grains can be used as seed crystals and can effectively be added as silver halide for grain growth. In the latter case, an emulsion having a smaller grain size is preferably added. The adding method thereof can be selected from the methods in which the entire amount is added at once, the entire amount is added in several aliquats, or it is continuously added. Further, grains having various halogen compositions are effectively added in some cases in order to modify the surface thereof.

A method in which a greater part or a lesser part of a halogen composition in the silver halide grains is converted by a halogen conversion method is described in U.S. Pat. Nos. 3,477,852 and 4,142,900, European Patents Nos. 273,429 and 273,430, and German Patent No. 3,819,241, and it is an effective method for preparing the grains. A soluble halide solution or the silver halide grains can be added in order to convert the grains to more scarcely soluble silver salts. The conversion method thereof can be selected from the methods in which the conversion is carried out at one time, the conversion is carried out dividing into several times, or the conversion is continuously carried out.

In addition to the method in which the grains are grown by adding a soluble silver salt and halide at a fixed concentration and a fixed flowing speed, preferred is the grain formation method in which the concentration is changed or the flowing speed is changed, as described in British Patent No. 1,469,480, and U.S. Pat. Nos. 3,650,757 and 4,242,455. The concentration or flowing speed can be increased to change the amount of silver halide supplied according to a linear function, a quadric function or a more complex function of the adding time. The amount of silver halide supplied is preferably decreased in some cases according to necessity. Further, where plural soluble silver salts having different solution compositions are added or plural soluble halides having different solution compositions are added, the adding manner in which one is increased and the other is decreased is also an effective method.

The mixing vessel for reacting the solutions of a soluble silver salt and a soluble halide can be selected from the methods described in U.S. Pat. Nos. 2,996,287, 3,342,605, 3,415,650, and 3,785,777, and German Patents No. 2,556,885 and 2,555,364.

In preparing an emulsion containing tabular grains, preferred is the method in which the addition speeds, addition amounts and addition concentrations of a silver salt solution (for example, a silver nitrate aqueous solution) and a halide solution (for example, KBr aqueous solution) are increased in order to accelerate the grain growth. These methods are described in, for example,. British Patent No. 1,335,925, U.S. Pat. Nos. 3,672,900, 3,650,757, and 4,242,445, and JP-A-55-142329 and 55-158124.

In preparing an emulsion of the-present invention, for example, in forming the grains, at a desalting step, in a chemical sensitization, or before coating, metal ions are preferably allowed to be present according to the purposes. Such doping of the metal ions can increase an excessive exposure which does not lead to causing a reinversion and decrease the minimum density. They are added preferably in forming the grains where they are doped in the grains, and after forming the grains to before completing chemical sensitization where they are used as a modifier or a chemical sensitizer for the grain surfaces. There can be selected as well the methods in which they are doped in the whole grain, only in a core portion, only in a shell portion, only in an epitaxial portion, or only in a base grain. There can be used Mg, Ca, Sr, Ba, Al, Sc, Y, La, Cr, Mn, Fe, Co, Ni, Cu, Zn, Ga, Ru, Rh, Pd, Re, 0s, Ir, Pt, Au, Cd, Hg, Tl, In, Sn, Pb, and Bi. These metals can be added as long as they are in the form of a salt which can be dissolved in preparing the grains, such as an ammonium salt, acetate, nitrate, sulfate, phosphate, a hexaligand complex salt, and a tetraligand complex salt. Examples of such salts $CdBr_2$, $CdCl_2$, $Cd(NO_3)_2$, $Pb(NO_3)_2$, $Pd(CH_3COO)_2$, $K_3[Fe(CN)_6]$, $(NH_4)_4[Fe(CN)_6]$, $K_3IrCl_6$, $NH_4RhCl_6$, and $K_4Ru(CN)_6$. The ligand for the coordinate compound can be selected from halo, aquo, cyano, cyanate, thiocyanate, nitrosyl, thionitrosyl, oxo, and carbonyl. Only one kind of metal compound may be used or two or more kinds thereof may be used in combination.

The metal compounds are preferably dissolved in a suitable solvent such as methanol and acetone to add them. There can used the method in which a hydrogen halide aqueous solution (for example, HCl and HBr) or an alkali halide aqueous solution (for example, KCl, NaCl, KBr, and NaBr) is added in order to stabilize a solution. Further, acid and alkali may be added according to necessity. The metal compounds can be added to the reaction vessel either before forming the grains or in the middle of the grain formation. They can also be added to a water soluble silver salt (for example, silver nitrate) or an alkali halide aqueous solution (for example, NaCl, KBr and KI) to continuously add them during the formation of the silver halide grains. Further, a solution independent from the water soluble silver salt and alkali halide may be prepared to continuously add it at a suitable period during the grain formation. Various adding methods are preferably combined.

The method in which the chalcogenide compounds described in U.S. Pat. No. 3,772,031 are added in preparing an emulsion is effective in some cases. In addition to S, Se and Te, cyanate, thiocyanate, seleno-cycnate, carbonate, phosphate, and acetate are allowed to be present.

These are described in U.S. Pat. Nos. 2,448,060, 2,628,167, 3,737,313, and 3,772,031, and Research Disclosure, vol. 134, 13452 (June 1975).

As described above, the internal latent image type silver halide grains used in the present invention preferably have a core/shell structure. The method for forming a shell is described in the examples of JP-A-63-151618, and U.S. Pat. Nos. 3,206,316, 3,317,322, 3,761,276, 4,269,927, and 3,367,778. In this case, the mole ratio (weight mole ratio) of core/shell is preferably 1/30 to 5/1, more preferably 1/20 to 2/1, and further more preferably 1/20 to 1/1.

In the silver halide emulsion of the present invention, after a core grain subjected to a chemical sensitization is covered with a shell, the surface of the grain is further subjected to a chemical sensitization in the presence of a polymer according to the present invention. In addition to the method in which a polymer according to the present invention is allowed to be present during the sensitization, the chemical sensitization can be carried out by publicly known methods, for example, a method in which active gelatin is used, as described in "*The Theory of the Photographic Process*", written by T. H. James, 4th ed., pp. 67 to 76, edited by MaCmillan Co., 1977; and further by a method in which sulfur, selenium, tellurium, gold, platinum, palladium, iridium, rhodium, osmium, rhenium, or a combination of a plurality of these sensitizers is used at pAg 5 to 10, pH 4 to 8 and the temperature of 30° to 80° C., as described in Research Disclosure, vol. 120, April 1974, 12008, Research Disclosure, vol. 34, June 1975, 13452, U.S. Pat. Nos. 2,642,361, 3,297,446, 3,772,031, 3,857,711, 3,901,714, 4,266,018, and 3,904,415, and British Patent No. 1,315,755.

Where the surface of the above core/shell type silver halide grains is subjected to a chemical sensitization in the presence of a polymer having the repetitive unit represented by Formula (I) according to the present invention, the polymer according to the present invention may be added to the emulsion containing the above core/shell type silver halide grains before the completion of the chemical sensitization. To be more specific, the polymer according to the present invention is added one time or divided into several times at some period of after the preparation of the core/shell type silver halide grains to before the completion of the chemical sensitization. In particular, the polymer according to the present invention is preferably added before adding the chemical sensitizer.

The amount of the polymer having the repetitive unit represented by Formula (I) to be used will vary according to the kind thereof and the conditions of the chemical sensitizer to be used. The desired effects can be obtained using an amount much less than the amount used where the polymer according to the present invention is used as a protective colloid and a binder. The polymer having the repetitive unit represented by Formula (I) is preferably used in an amount so that the total amount of the repetitive unit represented by Formula (I) contained in the polymer is from 0.002 to 1 g, particularly 0,002 to 0.5 g, and more preferably 0.002 to 0.2 g per mole of silver.

The chemical sensitization can be carried out as well in the presence of a chemical sensitization aid. Examples of chemical sensitization aids include compounds which are known to control fog and to increase sensitivity in the course of the chemical sensitization, such as azaindene, azapyridadine and azapyrimidine. Specific examples of chemical sensitization aids are described in U.S. Pat. Nos. 2,131,038, 3,411,914, and 3,554,757, JP-A-58-126526 and 62-253159, and "*Photographic Emulsion & Chemistry*" written by Duffin, pp. 138 to 143 (published by The Focal Press Co., 1966).

A silver halide emulsion can be subjected to a reduction sensitization in the inside of the grains in the course of a precipitation/formation as described in JP-B-58-1410, and *Journal of Photographic Science*, Moisar et al, vol. 25, pp. 19 to 27, 1977.

The following reduction sensitization can be applied as a chemical sensitization. The reduction sensitization can be carried out, for example, with hydrogen as described in U.S. Pat. Nos. 3,891,446 and 3,984,249. Further, the reduction sensitization can be carried out with a reducing agent as described in U.S. Pat. Nos. 2,518,698, 2,743,182 and 2,743,183, or by a processing at low pAg (for example, less than 5) or high pH (for example, more than 8). Publicly known conventional reduction sensitizers are stannous salts, ascorbic acid and the derivatives thereof, amines and polyamines, hydrazine derivatives, formamidinesulfinic acid, silane compounds, and borane compounds. These reduction sensitizers can be selected and used for the reduction sensitization. Two or more kinds of these compounds can be used as well in combination. Preferred as the reduction sensitizer are stannous chloride, thiourea dioxide, dimethylamine borane, and ascorbic acid and the derivatives thereof.

Further, the chemical sensitization methods described in U.S. Pat. Nos. 3,917,485 and 3,966,476 can be applied as well.

There can be applied as well the sensitizing method in which an oxidizing agent is used, as described in JP-A-61-3134 and 61-3136.

A "silver oxidizing agent" means a compound which acts on silver metal to convert it to silver ions. Particularly effective silver oxidizing agents are compound which convert a very fine silver grain by-produced in the course of the formation and chemical sensitization of the silver halide grains to silver ions. The silver ion formed either may form a silver salt which is scarcely soluble in water, such as silver halide, silver sulfide and silver selenide or may form a silver salt which is readily soluble in water, such as silver nitrate. The silver oxidizing agent may be either an inorganic compound or an organic compound. Examples of inorganic silver oxidizing agents include ozone, hydrogen peroxide and adducts thereof ( for example, $NABO_2 \cdot H_2O_2 \cdot 2H_2O$, $2NaCO_3 \cdot 3H_2O_2$, $Na_4P_2O_7 \cdot 2H_2O_2$, and $2Na_2SO_4 \cdot H_2O_2 \cdot 2H_2O$), an oxygen acid salt such as a peroxy acid salt (for example, $K_2S_2O_8$, $K_2C_2O_6$, and $K_2P_2O_8$), a peroxy complex compound (for example, $K_2[Ti(O_2)C_2O_4] \cdot 3H_2O$, and $4K_2SO_4 \cdot Ti(O_2)OH \cdot SO_4 \cdot 2H_2O$), permanganate (for example, $MMnO_4$), and chromate (for example, $K_2Cr_2O_7$), a halogen element such as iodine and bromine, a perhalogen acid salt (for example, potassium periodate), a high valence metal salt (for example, potassium hexacyanoferrate (III)), and thiosulfonate.

Further, examples of organic silver oxidizing agents include quinones such as p-quinone, organic peroxides such as peracetic acid and perbenzoic acid, and compounds release an active halogen (for example, N-bromosuccinimide, chloramine T, and chloramine B).

The preferred oxidizing agents according to the present invention are ozone, hydrogen peroxide and adducts thereof, inorganic oxidizing agents such as a halogen element and thiosulfonate, and the organic oxidizing agents based on quinones. The combined use of the above reduction sensitizer and silver oxidizing agent is a preferred embodiment. The method therefor can be selected from the method in which the oxidizing agent is used and then the reduction sensitization is provided, the method contrary thereto, and the method in which both are allowed to coexist at the same time. These methods can be selected and used either at a grain formation step or a chemical sensitization step.

With respect to the protective colloid used in the preparation of the emulsion according to the present invention, at least one polymer having repetitive unit derived from a ethylenically unsaturated monomer having at least one thioether structure on a side chain according to the present invention is required to be used as deflocculating agent (binder) at the stage of forming the silver halide grains. Other hydrophilic colloids such as gelatin can be used as well in combination with the above mentioned polymer.

There can be used, for example, proteins such as gelatin derivatives, graft polymers of gelatin and other polymers, albumin, and casein; cellulose derivatives such as hydroxyethyl cellulose, carboxymethyl cellulose, and cellulose sulfuric acid esters; sugar derivatives such as sodium alginate and starch derivatives; various synthetic hydrophilic high molecular substances such as homopolymers and copolymers of polyvinyl alcohol, partially acetalized polyvinyl alcohol, poly-N-vinyl pyrrolidone, polyacrylic acid, polymethacrylic acid, polyacrylamide, polyvinylimidazole, and polyvinylpyrazole.

There may be used as gelatin, acid-treated gelatin and enzyme-treated gelatin as described in *Bull. Soc. Sci. Photo. Japan*, No. 16, P 30 (1966) as well as lime-treated gelatin. Further, the hydrolysis products and enzyme decomposition products of gelatin can be used as well. A lot of impurity ions are contained in gelatin and gelatin which is subjected to a treatment with an ion exchange resin to decrease the amount of inorganic impurity ions is preferably used as well. The emulsion of the present invention is preferably washed with water to disperse in newly prepared protective colloid. The rinsing temperature scan be selected according to the purposes and is selected preferably in the range of 5° to 50° C. The pH value in rinsing can also be selected according to the purposes and is selected preferably in the range of 2 to 10, more preferably 3 to 8. The pAg value in rinsing can also be selected according to the purposes and is selected preferably in the range of 5 to 10. The rinsing method can be selected from a noodle rinsing method, a dialysis method with a semi-permeable membrane, a centrifugal method, a precipitation settling method, and an ion exchange method. In case of the precipitation settling method, it can be selected from the method in which sulfate is used, the method in which an organic solvent is used, the method in which a flocculation polymer is used, and the method in which a gelatin derivative is used.

In the present invention, a spectral sensitization can be carried out with a sensitizing dye. There are available as the sensitizing dye which can be used, a cyanine dye, a merocyanine dye, a composite cyanine dye, a composite merocyanine dye, a holopolarcyanine dye, a hemicyanine dye, a styryl dye, and a hemioxonol dye. To be specific, there can be enumerated the sensitizing dyes described in U.S. Pat. No. 4,617,257, JP-A-59-180550, 60-140335, and 61-160739, RD 17029 (1978) pp. 12 to 13, and RD 17643 (1978) pp. 23.

These sensitizing dyes may be used either singly or, in combinations thereof. A combination of sensitizing dyes is frequently used particularly for the purpose of supersensitization. Typical examples thereof are described in U.S. Pat. Nos. 2,688,545, 2,977,229, 3,397,060, 3,522,052, 3,527,641, 3,617,293, 3,628,964, 3,666,480, 3,672,898, 3,679,428, 3,703,377, 3,769,301, 3,814,609, 3,837,862, and 4,026,707, British Patents No. 1,344,281 and 1,507,803, JP-B-43-4936 and 53-12375, and JP-A-52-110618 and 52-109925.

In addition to the sensitizing dyes, there may be incorporated into an emulsion, dyes having no spectral sensitization action by themselves or materials which do not substantially absorb visible rays and show a supersensitization (for example, the compounds described in U.S. Pat. Nos. 3,615,613, 3,615,641, 3,617,295, 3,635,721, 2,933,390, and 3,743,510, and JP-A-63-23145).

The timing for adding a sensitizing dye to an emulsion may be at any step in the preparation of the emulsion which is known as useful. Most usually, the sensitizing dye is added during the period of from after the completion of a chemical sensitization to before coating. It can be added at the same period as the addition of a chemical sensitizer to carry out a spectral sensitization at the same period as the chemical sensitization, as described in U.S. Pat. Nos. 3,628,969 and 4,225,666; it can also be added prior to the chemical sensitization as described in JP-A-58-113928; or it can be added before the completion of settling the silver halide grains to start the spectral sensitization. Further, the above compounds can be divided and added, as taught in U.S. Pat. No. 4,225,666; that is, it is possible to add a part of these compounds prior to a chemical sensitization and to add the remainder after the completion of the chemical sensitization. The sensitizing dye may be added at any stage in the formation of the silver halide grains including the method disclosed in U.S. Pat. No. 4,183,756.

The addition amount of the sensitizing dye is $10^{-8}$ to $10^{-2}$ mole per mole of silver halide, and in case of a more preferred silver halide grain size of 0.2 to 1.2 μm, about $5\times10^{-5}$ to $2\times10^{-3}$ mole per mole of silver halide is more effective.

The coated amount of the light-sensitive silver halide used in the present invention is in the range of 1 mg to 10 g/m$^2$ in terms of the amount converted to silver.

In the present invention, various anti-fogging agents and photographic stabilizers can be used for the purpose of preventing reduction of the sensitivity and generation of fog. Examples thereof include azoles and azaindenes as described in RD 17643 (1978), pp. 24 to 25, and U.S. Pat. No. 4,629,678, carboxylic acids containing nitrogen and phosphoric acids as described in JP-A-59-168442, the mercapto compounds and the metal salts thereof as described in JP-A-59-111636, and acetylene compounds as described in JP-A-62-87957.

The following additives may also be used in the context of the present invention.

| Kind of additive | RD 17643 (Dec. 1978) | RD 18716 (Nov. 1979) | RD 307105 (Nov. 1989) |
|---|---|---|---|
| 1. Chemical sensitizer | pp. 23 | pp. 648, right colmn. | pp. 866 |
| 2. Sensitivity improver | — | pp. 648, right colmn. | — |
| 3. Spectral sensitizer, & super-sensitizer | pp. 23 to 24 — | pp. 648, right colmn. to pp. 649, right colmn. | pp. 866 to 868 |
| 4. Whitening agent | pp. 24 | pp. 647, | pp. 868 |
| 5. Anti-foggant & stabilizer | pp. 24 to 25 | pp. 649, right colmn. | pp. 868 to 870 |
| 6. Light absorber, filter dye, & UV absorber | pp. 25 to 26 | pp. 649, right colmn. to pp. 650, left colmn. | pp. 873 |
| 7. Anti-stain agent | pp. 25 right colmn. | pp. 650, left colmn. to right colmn. | pp. 872 |
| 8. Dye image stabilizer | pp. 25 | pp. 650, left colm. | pp. 872 |
| 9. Hardener | pp. 26 | pp. 651, left colmn. | pp. 874 to 875 |
| 10. Binder | pp. 26 | pp. 651, left colmn. | pp. 873 to 874 |
| 11. Plasticizer & lubricant | pp. 27 | pp. 650, right colmn. | pp. 876 |
| 12. Coating aid & surfactant | pp. 26 to 27 | pp. 650, right colmn. | pp. 875 to 876 |
| 13. Anti-static agent | pp. 27 | pp. 650, right colmn. | pp. 876 to 877 |
| 14. Matting agent | — | — | pp. 878 to 879 |

The respective constitutional elements included in the present invention will be explained below in order.

I. Light-sensitive sheet

A) Support:

Any support can be used for a support for the light-sensitive sheet used in the present invention as long as it is a flat and transparent support usually used for a photographic light-sensitive material. There can be used cellulose acetate, polystyrene, polyethylene terephthalate, and polycarbonate, and a subbing layer is preferably provided. The support usually contains a trace amount of a dye or a pigment such as titanium oxide in order to prevent light piping.

The thickness of the support is generally from 50 to 350 μm, preferably 70 to 210 μm, and more preferably 80 to 150 μm.

A layer for adjusting the curl balance or an oxygen-shielding layer described in JP-A-56-78833 can be provided on the back side of the support according to necessity.

B) Image-receiving layer

A dye image-receiving layer used in the present invention contains a mordant agent in a hydrophilic colloid. This layer may be a single layer or of a multi-layer constitution in which the mordant agents each having a different mordant power are provided one above the other. This is described in JP-A-61-252551. A polymer mordant is preferred as the mordant.

The polymer mordant agent is a polymer having a secondary or tertiary amino group, a polymer having a nitrogen-containing heterocyclic ring portion, or a polymer containing a quaternary cation. It is a polymer having a molecular weight of 5,000 or more, particularly preferably 10,000 or more.

The coated amount of the mordant agent is generally 0.5 to 10 g/m$^2$, preferably 1.0 to 5.0 g/m$^2$, and particularly preferably 2 to 4 g/m$^2$.

As a hydrophilic colloid for the image-receiving layer, gelatin, polyvinyl alcohol, poly-acrylamide, and polyvinyl pyrrolidone may be used. Gelatin is preferred.

There can be incorporated into the image-receiving layer, the anti-fading agents described in JP-A-62-30620 and 62-30621 and JP-A-62-215272.

C) White color reflection layer:

A white color reflection layer constituting a white background for a dye image usually contains a white pigment and a hydrophilic binder.

There can be used as the white pigment for the white color reflection layer, barium sulfate, zinc oxide, barium stearate, silver flake, silicates, alumina, zirconium oxide, zirconium sodium sulfate, kaolin, mica, and titanium dioxide. Further, a non-layer forming polymer grain consisting of styrene may be used as well. These may be used singly or as mixtures thereof in the range in which a desired reflection rate can be obtained.

A particularly useful white pigment is titanium dioxide.

The whiteness degree of the white color reflection layer is changed by the kind of the pigment, the mixture ratio of the pigment and the binder, and the coated amount of the pigment, and the light reflection rate is preferably 70% or more. In general, the more the coated amount of the pigment increases, the more the whiteness degree is improved. When an image-forming dye is diffused through this layer, the pigment resists the diffusion of the dye and therefore a suitable coated amount is preferably provided.

Titanium dioxide is coated in the amount of 5 to 40 g/m$^2$, preferably 10 to 25 g/m$^2$, and a white color reflection layer having a light reflection rate of 78 to 85% at the wavelength of 540 nm is preferred.

Titanium dioxide can be selected from various brands commercially available in the market. Of them, rutile type titanium dioxide is preferably used.

Many the commercially available products are subjected to a surface treatment with alumina, silica and zinc oxide, and the surface treatment amount is desirably 5% or more in order to obtain a high reflection degree. There are available as titanium dioxide commercially available in the market, for example, the compounds described in Research Disclosure No. 15162 as well as Ti-pure R 931 manufactured by Du Pont Co., Ltd.

There can be used as a binder for the white reflection layer, an alkali penetrable high polymer matrix, for example, gelatin, polyvinyl alcohol, and a cellulose derivative such as hydroxyethyl cellulose and carboxymethyl cellulose can be used.

The particularly preferred binder for the white color reflection layer is gelatin. The ratio of the white pigment to gelatin is 1/1 to 20/1 (ratio by weight), preferably 5/1 to 10/1 (ratio by weight).

The anti-fading agents described in JP-B-62-30620 and 62-30621 are preferably incorporated into the white color reflection layer.

D) Light shielding layer:

A light shielding layer containing a light shielding agent and a hydrophilic binder is provided between the white color reflection layer and light-sensitive layer.

Any of the materials having a light shielding function can be used as the light shielding agent, and carbon black is preferably used. Further, there may be used the degradable dyes described in U.S. Pat. No. 4,615,966 and others.

Any binder can be used as a binder for coating the light shielding agent as long as it can disperse carbon black, and gelatin is preferred.

There can be used as a raw material for carbon black, those manufactured by an arbitrary method such as a channel method, a thermal method and a furnace method each described in, for example, "Carbon Black" written by Donnel Voet, Marcel Dekker Inc. (1976). The grain size of carbon black is not specifically limited and is preferably 90 to 1800 Å. The addition amount of a black pigment as the light shielding agent may be adjusted according to the sensitivity of the light-sensitive material to be shielded, and it is preferably from 5 to 10 in terms of an optical density.

E) Light-sensitive layer:

In the present invention, a light-sensitive layer consisting of a silver halide emulsion layer combined with a dye image-forming material is provided over the above light shielding layer. The constitutional elements will be described below.

(1) Dye image-forming material:

The dye image-forming material used in the present invention is a non-diffusible compound which releases a diffusible dye (which may be a dye precursor) in relation to a silver development or a compound in which the diffusibility of the dye itself changes in relation to a silver development, and it is described in *The Theory of the Photographic Process*, fourth edition. Any of these compounds can be represented by the following Formula (II):

$$(DYE\text{-}Y)_n-Z \qquad \text{(II)}$$

wherein DYE represents a dye group, a dye group which is temporarily shifted to a short wavelength, or a dye precursor group; Y represents a single bond or a connecting group; Z represents a group having a nature by which the diffusibility of the compound represented by $(DYE\text{-}Y)_n-Z$ is differentiated corresponding or inversely corresponding with a light-sensitive silver salt having imagewise a latent image, or by which DYE is released and a diffusibility between released DYE and $(DYE\text{-}Y)_n\text{-}Z$ is differentiated corresponding or inversely corresponding with a light-sensitive silver salt having imagewise a latent image; n represents 1 or 2; and when n is 2, the two DYE-Y groups may be the same or different.

According to the function of this Z group, the dye image-forming materials are classified broadly into negative type compounds which become diffusible at a silver-developed area and positive type compounds which becomes diffusible at a non-developed area.

There can be enumerated as specific examples of negative type Z groups, those which are oxidized and split as the result of a development to release a diffusible dye.

Specific examples of Y are described in U.S. Pat. Nos. 3,928,312, 3,993,638, 4,076,529, 4,152,153, 4,055,428, 4,053,312, 4,198,235, 4,179,291, 4,149,892, 3,844,785, 3,443,943, 3,751,406, 3,443,939, 3,443,940, 3,628,952, 3,980,479, 4,183,753, 4,142,891, 4,278,750, 4,139,379, 4,218,368, 3,421,964, 4,199,355, 4,199,354, 4,135,929, 4,336,322, and 4,139,389, and JP-A-53-50736, 51-104343, 54-130122, 53-110827, 56-12642, 56-16131, 57-4043, 57-650, 57-20735, 53-69033, 54-130927, 56-164342, and 57-119345.

Of the Z groups in negative type dye-releasing redox compounds, there can be enumerated as particularly preferred groups, an N-substituted sulfamoyl group (the N-substituted sulfamoyl group includes a group which is derived from an aromatic hydrocarbon ring and a heterocyclic ring). Representative examples of such Z groups are shown below but the invention is not limited thereto.

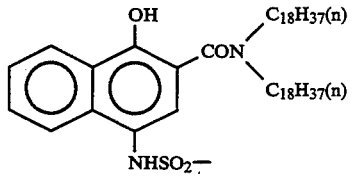

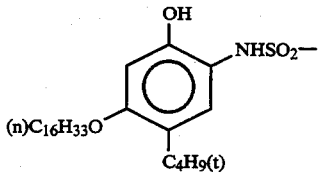

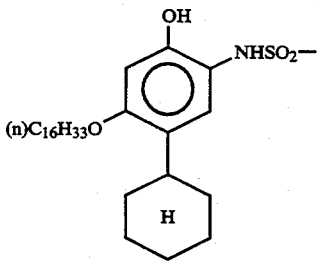

-continued

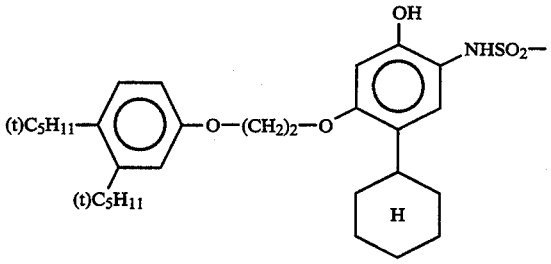

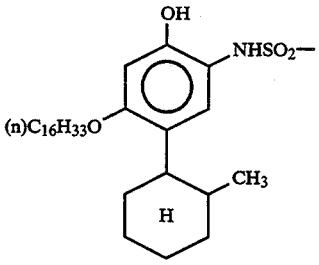

The positive type compounds are described in *Angev. Chem. Inst. Ed. Engl.* vol. 22, pp. 191 (1982).

There can be enumerated as specific examples thereof, a compound (a dye developing agent) which is initially diffusible under alkaline conditions but is oxidized by a development to become non-diffusible. Those which are given in U.S. Pat. No. 2,983,606 are typical as Z groups which are effective for the compounds of this type.

Another type is the compound which is subjected to a self-ring closure under alkaline conditions to release a diffusible dye but is oxidized upon a development to substantially stop releasing the dye. Specific examples of Z groups having such a function are described in U.S. Pat. No. 3,980,479, JP-A-53-69033 and 54-130927, and U.S. Pat. Nos. 3,421,964 and 4,199,355.

Further, there is available as another type, the compound which does not release a dye by itself but releases the dye when it is reduced. The compound of this type is used in combination with a electron-providing material and can release imagewise a diffusible dye by a reaction with the remainder of the electron-providing material which is imagewise oxidized by a silver development. The atomic groups having such a function are described in, for example, U.S. Pat. Nos. 4,183,753, 4,142,891, 4,278,750, 4,139,379, and 4,218,368, JP-A-53-110827, U.S. Pat. Nos. 4,278,750, 4,356,249, and 4,358,525, JP-A-53-110827, 54-130927, and 56-164342, Kokai Giho 87-6199, and European Patent Publication No. 220746A2. Specific examples thereof are shown below but the invention is not limited only thereto.

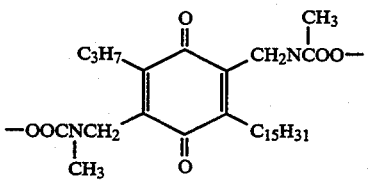

-continued

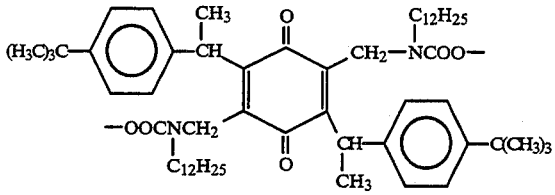

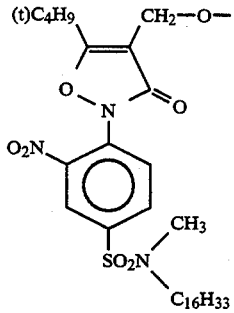

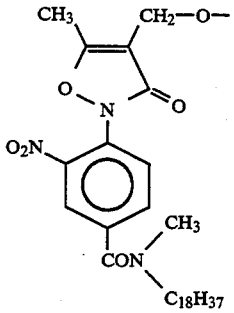

Where a compound of this type is used, it is used preferably in combination with an anti-diffusion electron—providing material (known as an ED compound) or a precursor thereof. Examples of ED compounds are described in U.S. Pat. Nos. 4,263,393 and 4,278,750, and JP-A-56-138736.

The following compound is a specific example of a dye image-forming material of another type:

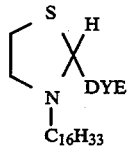

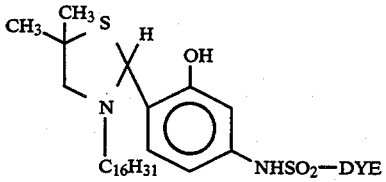

wherein DYE represents the same dye or precursor thereof as that described previously.

The details thereof are described in U.S. Pat. Nos. 3,719,489 and 4,098,783.

Meanwhile, specific examples of the dye represented by DYE in the foregoing formula are described in the following publications:

Examples of a yellow dye

The compounds described in U.S. Pat. Nos. 3,597,200, 3,309,199, 4,013,633, 4,245,028, 4,156,609, 4,139,383, 4,195,992, 4,148,641, 4,148,643, and 4,336,322, JP-A-51-114930 and 56-71072, and Research Disclosure 17630 (1978) and 16475 (1977).

Examples of a magenta dye

The compounds described in U.S. Pat. Nos. 3,453,107, 3,544,545, 3,932,380, 3,931,144, 3,932,308, 3,954,476, 4,233,237, 4,255,509, 4,250,246, 4,142,891, 4,207,104, and 4,287,292, and JP-A-52-106727, 53-23628, 55-36804, 56-73057, 56-71060, and 55-134.

Examples of a cyan dye

The compounds described in U.S. Pat. Nos. 3,482,972, 3,929,760, 4,013,635, 4,268,625, 4,171,220, 4,242,435, 4,142,891, 4,195,994, 4,147,544, and 4,148,642, British Patent No. 1,551,138, JP-A-54-99431, 52-8827, 53-47823, 53-143323, 54-99431, and 56-71061, European Patents No. (EPC) 53,037 and 53,040, and Research Disclosures 17630 (1978) and 16475 (1977).

These compounds can be dispersed by the method described at pages 144 to 146 of JP-A-62-215272. Further, the compounds described at pages 137 to 144 of JP-A-62-215272 may be incorporated into these dispersions.

(2) Silver halide emulsion:

The foregoing emulsion is used for the silver halide emulsion of the present invention.

(3) Constitution of the light-sensitive layer:

There is used for the reproduction of a natural color by a subtractive color process, a light-sensitive layer comprising a combination of at least two components of an emulsion spectrally sensitized by the above spectral sensitizing dye and the above dye image-forming material which provides a dye having a selective spectral absorption in the same wavelength range. The emulsion and the dye image-forming material may be provided each in a different layer superposing one on another or both may be mixed to apply in a single layer. Where the dye image-forming material has an absorption in the spectral sensitivity region of the emulsion combined therewith when it is coated, both are preferably provided each in a different layer. Also, the emulsion layer may consist of plural emulsion layers each having a different sensitivity, or an arbitrary layer may be provided between the emulsion layer and dye image-forming material layer. There can be provided, for example, a layer containing a nucleus-forming development accelerator, described in JP-A-60-173541, and a partition wall layer described in JP-B-60-15267 to increase the dye image density, and a reflection layer can be provided as well to raise the sensitivity of the light-sensitive element.

The reflection layer is a layer containing a white pigment and a hydrophilic binder. The white pigment is preferably titanium oxide and the hydrophilic binder is preferably gelatin. The coated amount of titanium oxide is 0.1 to 8 g/m$^2$, preferably 0.2 to 4 g/m$^2$. An example of the reflection layer is described in JP-A-60-91354.

In a preferred multilayer constitution, there are provided in order from an exposure side, a combination unit of a blue-sensitive emulsion, a combination unit of a green-sensitive emulsion, and a combination unit of a red-sensitive emulsion.

An arbitrary layer can be provided between the respective emulsion layer units according to necessity. In particular, an intermediate layer is preferably provided in order to prevent an unfavorable affection which an effect by a development in some layer exerts to other emulsion layer units.

Where a developing agent is used in combination with a non-diffusible dye image-forming material, an intermediate layer preferably contains a non-diffusible reducing agent in order to prevent the diffusion of the oxidation product of the developing agent. To be specific, there can be enumerated non-diffusible hydroquinone, sulfonamidephenol, and sulfonamidenaphthol. To be more specific, non-diffusible reducing agents are described in JP-B-50-21249 and 50-23813, JP-A-49-106329 and 49-129535, U.S. Pat. Nos. 2,336,327, 2,360,290, 2,403,721, 2,544,640, 2,732,300, 2,782,659, 2,937,086, 3,637,393, and 3,700,453, British Patent No. 557,750, and JP-A-57-24941 and 58-21249. The methods for dispersing them are described in JP-A-60-238831 and JP-B-60-18978.

Where a compound releasing a diffusible dye by a silver ion is used as described in JP-B-55-7576, a compound capturing the silver ion is preferably incorporated into an intermediate layer.

In the present invention, an anti-irradiation layer, a UV absorbing layer and a protective layer are provided according to necessity.

F) Peeling layer:

In the present invention, a peeling layer can be provided according to necessity in order to peel off at an arbitrary portion of a light-sensitive sheet in a unit after processing. Accordingly, this peeling layer has to be readily peeled off after processing. There can be used as the material for this, the compounds described in, for example, JP-A-47-8237, 59-220727, 59-229555, and 49-4653, U.S. Pat. Nos. 3,220,835 and 4,359,518, JP-A-49-4334, 56-65133, and 45-24075., and U.S. Pat. Nos. 3,227,550, 2,759,825, 4,401,746, and 4,366,227. A water soluble (or alkali soluble) cellulose derivative can be enumerated as one of the specific examples thereof. There are available, for example, hydroxyethyl cellulose, cellulose acetate phthalate, plasticized methyl cellulose, ethyl cellulose, cellulose nitrate, and carboxymethyl cellulose. There are available as an another example, various natural high polymers, for example, alginic acid, pectin, and gum arabic. There can be used as well various modified gelatins, for example, acetylized gelatin and phthalized gelatin. Further, a water soluble synthetic polymer can be enumerated as an another example. There are available, for example, polyvinyl alcohol, polyacrylate, polymethyl methacrylate, polybutyl methacrylate, and copolymers thereof.

The peeling layer may consist of either a single layer or plural layers as described in, for example, JP-A-59-220727 and 60-60642.

II. Cover sheet

In the present invention, in order to evenly spread a processing solution on a light-sensitive element and neutralize alkali after processing to stabilize an image, there is used a transparent cover sheet having a layer (a neutralization layer and a neutralization timing layer) having a neutralizing function.

G) Support

Any support can be used as a support for the cover sheet used in the present invention as long as it is a flat and transparent support usually used for a photographic light-sensitive material. There are used cellulose acetate, polystyrene, polyethylene terephthalate, and polycarbonate, and a subbing layer is preferably provided.

A trace amount of a dye is preferably incorporated into the support in order to prevent light piping.

H) Layer having a neutralizing function:

The layer having a neutralizing function used in the present invention is a layer containing an acid material in an amount sufficient to neutralize the alkali carried over from a processing composition, and it may also be of a multilayer constitution comprising a neutralizing speed controlling layer (a timing layer) and an adhesiveness strengthening layer according to necessity. The preferred acid material is a material containing an acid group having a pKa of 9 or less (or a precursor group giving such an acid group by a hydrolysis). There can be enumerated more preferably higher fatty acids such as oleic acid described in U.S. Pat. No. 2,983,606, and polymers of acrylic acid, methacrylic acid or maleic acid, and the partially esterified or acid anhydride polymers thereof, as disclosed in U.S. Pat. No. 3,362,819; copolymers of acrylic acid and acrylic acid ester, as disclosed in French Patent No. 2,290,699; and latex type acid polymers, as disclosed in U.S. Pat. No. 4,139,383 and Research Disclosure No. 16102 (1977).

In addition to the above, there can also be enumerated the acid materials disclosed in U.S. Pat. No. 4,088,493, and JP-A-52-153739, 53-1023, 53-4540, 53-4541, and 53-4542.

Specific examples of the acid polymer are a copolymer of a vinyl monomer such as ethylene, vinyl acetate and vinyl methyl ether and maleic anhydride, and n-butyl esters thereof, a copolymer of butyl acrylate and acrylic acid, cellulose, and acetate hydrogen phthalate.

The above polymers can be used by mixing with a hydrophilic polymer. Such polymers are polyacrylamide, polymethyl pyrrolidone, polyvinyl alcohol (including a partially saponified polymer), carboxymethyl cellulose, hydroxymethyl cellulose, hydroxyethyl cellulose, and polymethylvinyl ether. Of them, polyvinyl alcohol is preferred.

A polymer other than a hydrophilic polymer, for example, cellulose acetate, may be mixed in the above polymer acid.

The coated amount of the polymer acid is regulated by the amount of alkali spread in the light-sensitive element. The equivalent ratio per unit area of the polymer acid to alkali is preferably 0.9 to 2.0. Too small an amount of the polymer acid changes the hue of the transferred dye and causes stain on a white background. Meanwhile, an excessive amount thereof causes inconveniences such as changes in the hue and reduction of light resistance. A more preferable equivalent ratio is 1.0 to 1.3. Either an excessive or too small an amount of a hydrophilic polymer to be mixed deteriorates the quality of theresuiting photograph. The weight ratio of the hydrophilic polymer to the polymer acid is 0.1 to 10, preferably 0.3 to 3.0.

In the present invention, the additives can be incorporated into the layer having a neutralizing function for various purposes. For example, there can be added a hardener which is known to persons of ordinary skill in the art for the purpose of hardening this layer, and a polyhydric hydroxyl compound such as polyethylene glycol, polyepropylene glycol and glycerine in order to improve the fragility of the layer. In addition to the above, there also can be added according to necessity, an anti-oxidation agent, a fluorescent whitening agent, and a development inhibitor and a precursor thereof.

Useful for a timing layer which is used in combination with a neutralizing layer are, for example, a polymer which lowers the alkali permeability, such as gelatin, polyvinyl alcohol, a partially acetalized product of polyvinyl alcohol, cellulose acetate, and partially hydrolyzed polyvinyl acetate; a latex polymer which is prepared by copolymerizing a small amount of a hydrophilic comonomer such as an acrylic acid monomer and which increases the activation energy for an alkali permeation; and a polymer having a lactone ring.

Above all, particularly useful are a timing layer in which cellulose acetate is used, disclosed in JP-A-54-136328, and U.S. Pat. Nos. 4,267,262, 4,009,030, and 4,029,849; a latex polymer prepared by copolymerizing a small amount of a hydrophilic comonomer such as acrylic acid, disclosed in JP-A54-128335, 56-69629, and 57-6843, and U.S. Pat. Nos. 4,056,394, 4,061,496, 4,199,362, 4,250,243, 4,256,827, and 4,268,604; the polymer having a lactone ring, disclosed in U.S. Pat. No. 4,229,516; and in addition, the polymers disclosed in JP-A-56-25735, 56-97346, and 57-6842, and European Patents No. (EP) 31,957A1, 37,724A1, and 48,412A1.

In addition to the above compounds, those described in the following publications can be used as well: U.S. Pat. Nos. 3,421,893, 3,455,686, 3,575,701, 3,778,265, 3,785,815, 3,847,615, 4,088,493, 4,123,275, 4,148,653, 4,201,587, 4,288,523, and 4,297,431, German Patents No. (OLS) 1,622,936 and 2,162,277, and Research Disclosure 15162, No. 151 (1976).

The timing layer in which these materials are used may be used in a single layer or in combinations of two or more layers.

It is possible to incorporate into the timing layer comprising these materials, for example, the development inhibitors and/or precursors thereof, disclosed in U.S. Pat. No. 4,009,029, German Patents No. (OLS) 2,913,164 and 3,014,672, and JP-A-54-155837 and 55-138745; a hydroquinone precursor disclosed in U.S. Pat. No. 4,201,578; and other photographically useful additives or precursors thereof.

Further, an auxiliary neutralizing layer can be provided as a neutralizing layer as described in JP-A-63-168468 and 63-168649, which is effective in terms of lowering the change in the transfer density attributable to aging after processing.

I) Others

In addition to the layer having a neutralizing function, there may be provided as a layer having an auxiliary function, a back layer, a protective layer, a capturing mordant layer, and a filter dye layer.

The back layer is provided in order to adjust curling and give lubrication. A filter dye may be added to this layer.

The protective layer is used mainly for the purpose of preventing an adhesion with a cover sheet back face and an adhesion with a protective layer of a light-sensitive material when the light-sensitive material and cover sheet are superposed.

The capturing mordant layer can capture a dye which is diffused to an alkali processing composition side to prevent the delay of a dye image formation time and the deterioration of sharpness. A dye capturing layer is usually provided on the outermost layer of the cover sheet. The dye capturing layer contains a polymer mordant in gelatin as is the case in the above mentioned dye-receiving layer and is described in JP-A-1-198747 and 2-282253.

A dye can be incorporated into the cover sheet to control the sensitivity of the light-sensitive layer. A filter dye may be added directly to the support of a cover sheet, a layer having a neutralizing function, and further the above back layer, protective layer and capturing mordant layer, or an independent layer containing it may be provided. There can be incorporated into any of the light-sensitive sheet, cover sheet and alkali processing composition, the development accelerators described at pages 72 to 91, the hardeners described at pages 146 to 155, the surface active agents described at pages 201 to 210, the fluorine-containing compounds described at pages 210 to 222, the thickeners described at pages 225 to 227, the anti-electrification agents described at pages 227 to 230, the polymer latexes described at pages 230 to 239, and the matting agents described at page 240 each of JP-A-62-215272.

III. Alkali processing composition

The processing composition used in the present invention is uniformly spread on the light-sensitive element after the light-sensitive element is exposed, and paired with a light shielding layer provided on the back side of a support or the side opposite to a processing solution on a light-sensitive layer to completely shield the light-sensitive layer from light coming from the outside. In addition, the processing composition develops the light-sensitive layer with the components contained therein. For this purpose, there are contained in the composition, alkali, a thickener, a light shielding agent, a developing agent, a developing accelerator and developing inhibitor each used for adjusting the development, and an anti-oxidation agent used for preventing the developing agent from deterioration. It is essential to incorporate a light shielding agent in the composition.

Alkali is used in an amount sufficient to adjust the pH to 12 to 14 and there can be enumerated hydroxides of alkali metals (for example, sodium hydroxide, potassium hydroxide and lithium hydroxide), phosphates of alkali metals (for example, potassium phosphate), guanidines, and hydroxides of quaternary amines (for example, tetramethylammonium hydroxide). Of them, potassium hydroxide and sodium hydroxide are preferred.

A thickener is necessary for uniformly spreading the processing solution and keeping an adhesiveness between the light-sensitive layer and the cover sheet. There is used, for example, polyvinyl alcohol, hydroxyethyl cellulose, and a metal salt of carboxymethyl cellulose. Hydroxyethyl cellulose and sodium carboxymethyl cellulose are preferably used.

There can be used as the light shielding agent, either a dye or pigment, or a combination thereof as long as it does not diffuse to the dye image-receiving layer to generate a stain. Carbon black can be given as a typical example thereof.

Any developing agent can be used as a preferred developing agent as long as it subjects the dye image-forming material to a cross-oxidation and does not substantially generate a stain upon oxidation. The developing agent may be used singly or in combinations of two or more kinds or in the form of a precursor. These developing agents may be contained in a suitable layer of a light-sensitive element or in an alkaline processing solution. Specific examples include aminophenols and pyrazolidinones. Of them, pyrazolidinones are particularly preferred because they generate less stain.

There can be enumerated, for example, 1-phenyl-3-pyrazolidinone, 1-p-tolyl-4,4-dihydroxymethyl-3-pyrazolidinone, 1-(3'-methyl-phenyl)-4-methyl-4-hydroxymethy-3-pyrazolidinone, 1-phenyl-4-methyl-4-hydroxymethyl-3-pyrazolidinone, and 1-p-tolyl-4-methyl-4-hydroxymethyl-3-pyrazolidinone.

EXAMPLES

The present invention will be illustrated below with reference to specific examples but is not limited thereby.

Example 1

First, the preparation method for the silver halide emulsion will be explained.

Eight kinds of silver halide emulsion grains (Emulsion-A1 to Emulsion-A4 and Emulsion-B1 to Emulsion-B4) shown in Table A were prepared according to the emulsion grain preparation method described below.

TABLE A

| Emulsion grains prepared | |
|---|---|
| Emulsion No. | Form of the emulsion grains prepared |
| Emulsion A1 | Monodispersed octahedral grains (silver bromide) having a diameter of 1.40 μm |
| Emulsion A2 | Monodispersed octahedral grains (silver bromide) having a diameter of 1.40 μm |
| Emulsion A3 | Monodispersed octahedral grains (silver bromide) having a diameter of 1.40 μm |
| Emulsion A4 | Monodispersed octahedral grains (silver bromide) having a diameter of 1.40 μm |
| Emulsion B1 | Monodispersed octahedral grains (silver bromide) having a diameter of 0.70 μm |
| Emulsion B2 | Monodispersed octahedral grains (silver bromide) having a diameter of 0.70 μm |
| Emulsion B3 | Monodispersed octahedral grains (silver bromide) having a diameter of 0.70 μm |
| Emulsion B4 | Monodispersed octahedral grains (silver bromide) having a diameter of 0.70 μm |

Preparation of Emulsion-A4

(octahedral internal latent image type direct positive emulsion):

A 0.4M silver nitrate aqueous solution and a 0.4M potassium bromide aqueous solution were added to a 8 weight % 3-thiapentyl acrylate/sodium 2-acrylamide-2-methylpropanesulfonate (1/6 mole ratio) aqueous solution 1000 ml containing 13 g of potassium bromide and 0.05 g of 1,8-dihydroxy-3,6-dithiaoctane by a double jet method while maintaining the temperature at 75° C., wherein the silver nitrate aqueous solution 300 ml was added over a period of 40 minutes while controlling the addition speed of the potassium bromide aqueous solution so that the pBr was maintained at 1.30.

After completing the addition, there were formed the octahedral silver bromide grains (hereinafter referred to as core grains) having a uniform grain size with an average grain size (in terms of the sphere-corresponding diameter) of 0.8 μm.

Next, sodium thiosulfate 0.7 mg and potassium chloraurate 0.4 mg (both were added in the form of aqueous solutions) were added to the silver bromide grains thus prepared and the emulsion was heated at 75° C. for 80 minutes to thereby subject it to a chemical sensitization processing. A 0.8M silver nitrate aqueous solution and a 0.8M potassium bromide aqueous solution were added to the core grains thus subjected to the chemical sensitization by a double jet method while maintaining the temperature at 75° C. as was done in the preparation of the core grains, wherein the silver nitrate aqueous solution 740 ml was added over a period of 60 minutes while controlling the addition speed of the potassium bromide aqueous solution so that the pBr was maintained at 1.30.

This emulsion was washed with water by a conventional flocculation method and further, 3-thiapentyl acrylate/sodium 2-acrylamide-2-methyl-propanesulfonate (1/6 mole ratio) was added, whereby there were obtained the octahedral silver bromide grains (hereinafter referred to as an internal latent image type core/shell grain) having a uniform grain size with an average grain size (in terms of the sphere-corresponding diameter) of 1.4 μm.

Next, sodium thiosulfate 0.4 mg and poly(N-vinylpyrrolidone) 20 mg according to the present invention each per mole of silver were added to this internal latent image type core/shell emulsion and the emulsion was heated at 60° C. for 60 minutes to subject the grain surfaces to chemical sensitization, whereby the octahedral internal latent image type direct positive emulsion was prepared.

Preparation of Emulsion-B4

(octahedral internal latent image type direct positive emulsion):

A 0.4M silver nitrate aqueous solution and a 0.4M potassium bromide aqueous solution were added to a 8 weight % 3-thiapentyl acrylate/sodium 2-acrylamide-2-methylpropanesulfonate (1/6 mole ratio) aqueous solution 1000 ml containing 13 g of potassium bromide and 1.3 g of 1,8-dihydroxy-3,6-dithiaoctane by a double jet method while maintaining the temperature at 75° C., wherein the silver nitrate aqueous solution 300 ml was added over a period of 5 minutes while controlling the addition speed of the potassium bromide aqueous solution so that the pBr was maintained at 1.30.

After completing the addition, there were formed the octahedral silver bromide grains (hereinafter referred to as core grains) having a uniform grain size with an average grain size (in terms of the sphere-corresponding diameter) of about 0.4 μm. Next, sodium thiosulfate 1.4 mg and potassium chloraurate 0.8 mg (both were added in the form of aqueous solutions) were added to the silver bromide grains thus prepared and the emulsion was heated at 75° C. for 80 minutes to subject it to a chemical sensitization processing. A 0.8M silver nitrate aqueous solution and a 0.8M potassium bromide aqueous solution were added to the core grains thus subjected to the chemical sensitization by a double jet method while maintaining the temperature at 75° C. as was done in the preparation of the core grains, wherein the silver nitrate aqueous solution 740 ml was added over the period of 30 minutes while controlling the addition speed of the potassium bromide aqueous solution so that the pBr was maintained at 1.30.

This emulsion was washed with water by a conventional flocculation method and further, 3-thiapentyl acrylate/sodium 2-acrylamide-2-methyl-propanesulfonate (1/6 mole ratio) was added, whereby there were obtained the octahedral silver bromide grains (hereinafter referred to as an internal latent image type core/shell grain) having a uniform grain size with an average grain size (in terms of the sphere-corresponding diameter) of about 0.7 μm.

Next, sodium thiosulfate 0.8 mg and poly(N-vinylpyrrolidone) 40 mg according to the present invention each per mole of silver were added to this internal latent image type core/shell emulsion and the emulsion was heated at 60° C. for 60 minutes to subject the grain surfaces to chemical sensitization, whereby the octahedral internal latent image type direct positive emulsion was prepared.

Emulsions-A3 and B3 were prepared in the same manner as those in Emulsions-A4 and B4 except that poly(N-vinylpyrrolidone) was not added.

Emulsions-A2 and B2 were prepared in the same manner as those in Emulsions-A4 and B4 except that 3-thiapentyl acrylate/sodium 2-acrylamide-2-methylpropane-sulfonate (1/6 mole ratio) was replaced with the same amount of gelatin.

Emulsions-A1 and B1 were prepared in the same manner as those in Emulsions-A2 and B2 except that poly(N-vinylpyrrolidone) was not added.

The preparation methods are shown in Table B.

TABLE B

| Emulsion preparation methods | | |
|---|---|---|
| Emulsion No. | Addition amount* | Binder |
| Emulsion A1 (Comp.) | — | Gelatin |
| Emulsion A2 (Comp.) | 20 mg | |
| Emulsion B1 (Comp.) | — | |
| Emulsion B2 (Comp.) | 40 mg | |
| Emulsion A3 (Comp.) | — | 3-Thiapentyl acrylate/sodium 2-acrylamide-2-methylpropanesulfonate (1/6 mole ratio) |
| Emulsion A4 (Inv.) | 20 mg | |
| Emulsion B3 (Comp.) | — | |
| Emulsion B4 (Inv.) | 40 mg | |

*the addition amount of poly(N-vinylpyrrolidone)

These emulsions were used to prepare a comparative light-sensitive element (Sample 101) and light-sensitive elements of the present invention each having the constitutions shown below.

| Constitution of the comparative light-sensitive element 101: | Coated amount ($g/m^2$) |
|---|---|
| Twenty first layer: a protective layer | |
| Gelatin | 1.00 |
| Matting agent (1) | 0.25 |
| Twentieth layer: a UV absorbing layer | |
| Gelatin | 0.50 |
| UV absorber (1) | $4.0 \times 10^{-4}$ |
| UV absorber (2) | $4.0 \times 10^{-4}$ |
| Nineteenth layer: a yellow-sensitive layer (high sensitivity) | |
| Emulsion-A1 | converted to silver 0.60 |
| Sensitizing dye (3) | $1.4 \times 10^{-3}$ |
| Nucleus-forming agent (1) | $6.8 \times 10^{-8}$ |
| Additive (2) | 0.03 |
| Gelatin | 0.70 |
| Eighteenth layer: a yellow-sensitive layer (low sensitivity) | |

-continued

| | |
|---|---|
| Emulsion-B1 | converted to silver 0.25 |
| Sensitizing dye (3) | $9.0 \times 10^{-4}$ |
| Nucleus-forming agent (1) | $8.0 \times 10^{-8}$ |
| Additive (2) | $4.5 \times 10^{-2}$ |
| Gelatin | 0.40 |
| Seventeenth layer: a white reflection layer | |
| Titanium dioxide | 0.70 |
| Gelatin | 0.18 |
| Sixteenth layer: a yellow color material layer | |
| Yellow dye-releasing compound (1) | 0.53 |
| High boiling organic solvent (1) | 0.13 |
| Additive (1) | $1.4 \times 10^{-2}$ |
| Gelatin | 0.70 |
| Fifteenth layer: an intermediate layer | |
| Gelatin | 0.30 |
| Fourteenth layer: an anti-color mixing layer | |
| Additive (1) | 0.80 |
| Polymethyl methacrylate | 0.80 |
| Gelatin | 0.45 |
| Thirteenth layer: a green-sensitive layer (high sensitivity) | |
| Emulsion-A1 | converted to silver 0.80 |
| Sensitizing dye (2) | $2.1 \times 10^{-3}$ |
| Nucleus-forming agent (1) | $2.5 \times 10^{-8}$ |
| Additive (2) | 0.08 |
| Gelatin | 1.00 |
| Twelfth layer: a green-sensitive layer (low sensitivity) | |
| Emulsion-B1 | converted to silver 0.25 |
| Sensitizing dye (2) | $1.1 \times 10^{-3}$ |
| Nucleus-forming agent (1) | $4.4 \times 10^{-8}$ |
| Additive (2) | 0.03 |
| Gelatin | 0.50 |
| Eleventh layer: a white reflection layer | |
| Titanium dioxide | 1.00 |
| Gelatin | 0.25 |
| Tenth layer: a magenta color material layer | |
| Magenta dye-releasing compound (1) | 0.50 |
| High boiling organic solvent (1) | 0.10 |
| Additive (1) | $9.0 \times 10^{-3}$ |
| Gelatin | 0.90 |
| Ninth layer: an intermediate layer | |
| Gelatin | 0.30 |
| Eighth layer: an anti-color mixing layer | |
| Additive (1) | 1.20 |
| Polymethyl metacrylate | 1.20 |
| Gelatin | 0.70 |
| Seventh layer: a red-sensitive layer (high sensitivity) | |
| Emulsion-A1 | converted to silver 0.50 |
| Sensitizing dye (1) | $6.2 \times 10^{-4}$ |
| Nucleus-forming agent (1) | $5.0 \times 10^{-8}$ |
| Additive (2) | 0.04 |
| Gelatin | 0.80 |
| Sixth layer: a red-sensitive layer (low sensitivity) | |
| Emulsion-B1 | converted to silver 0.15 |
| Sensitizing dye (1) | $3.0 \times 10^{-4}$ |
| Nucleus-forming agent (1) | $5.0 \times 10^{-8}$ |
| Additive (2) | 0.02 |
| Gelatin | 0.40 |
| Fifth layer: a white reflection layer | |
| Titanium dioxide | 3.00 |
| Gelatin | 0.80 |
| Fourth layer: a cyan color material layer | |
| Cyan dye-releasing compound (1) | 0.50 |
| High boiling organic solvent (1) | 0.10 |
| Additive (1) | 0.01 |
| Gelatin | 1.00 |
| Third layer: an opaque layer | |
| Carbon black | 1.70 |
| Gelatin | 1.70 |
| Second layer: a white reflection layer | |
| Titanium dioxide | 22.00 |
| Gelatin | 2.75 |
| First layer: an image-receiving layer | |
| Polymer mordant (1) | 3.00 |
| Gelatin | 3.00 |

Support (polyethylene terephthalate 150 μm)
Polymer mordant (1)

-continued
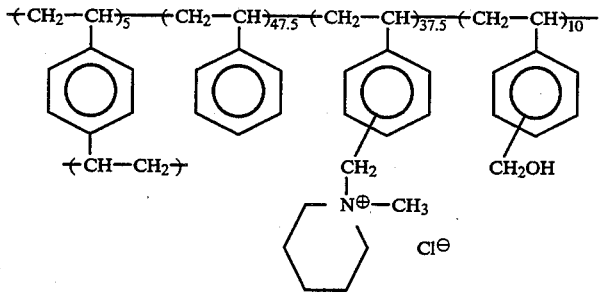
UV absorber (1)
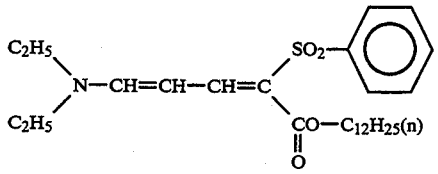
UV absorber (2)
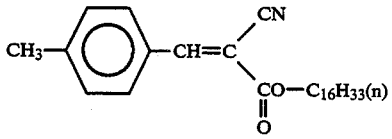
Matting agent (1)
Polymethyl metacrylate spherical latex
(average grain size: 4 μm)
Cyan dye-releasing compound (1)
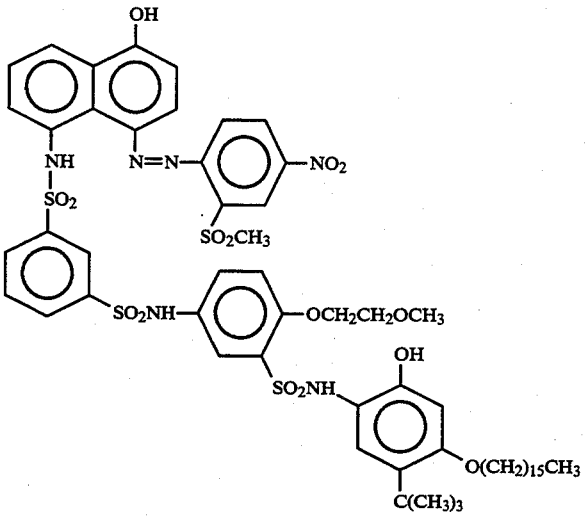
Magenta dye-releasing compound (1)

-continued
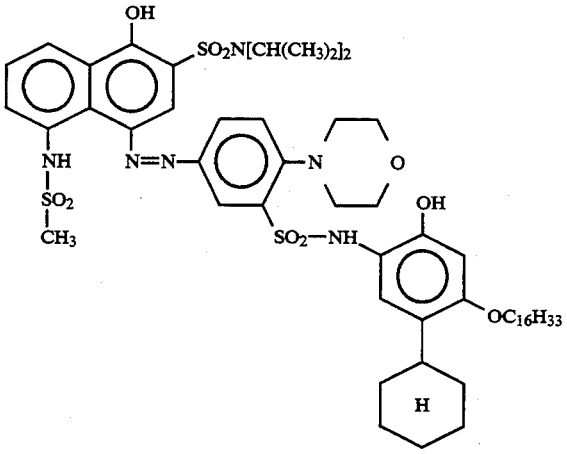
Yellow dye-releasing compound (1)
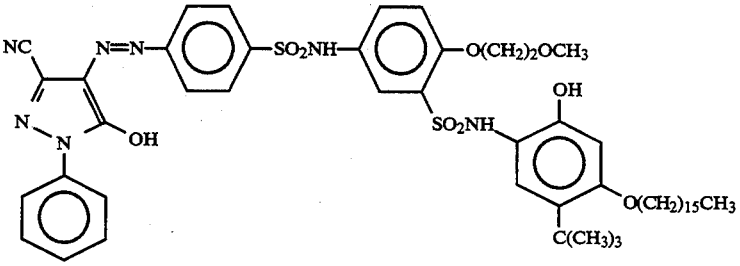
Additive (1)
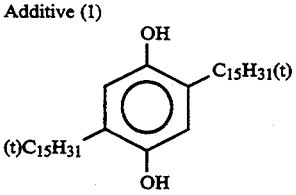
Additive (2)
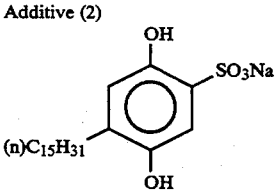
High boiling solvent
Tricyclohexyl phosphate
Nucleus-forming agent (1)
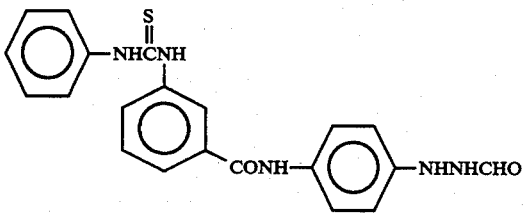
Sensitizing dye (1)
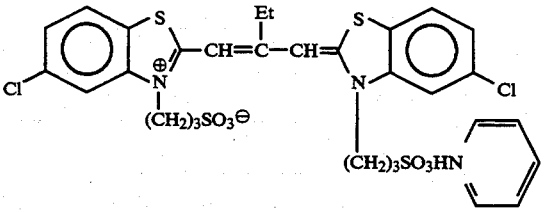

-continued

Sensitizing dye (2)

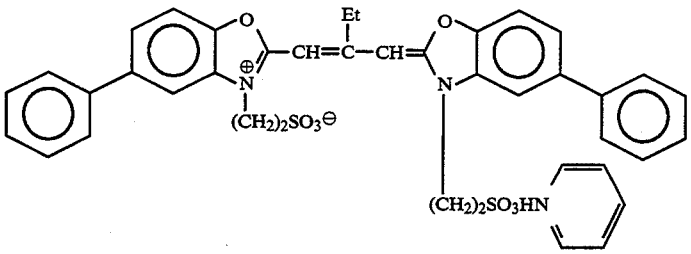

Sensitizing dye (3)

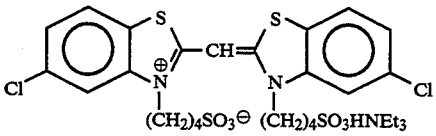

The cover sheet was prepared as follows.

The following layers were coated on a polyethylene terephthalate transparent support subbed with gelatin and containing an anti-light piping dye:

(1) a neutralizing layer containing an acrylic acid—butyl acrylate copolymer (mole ratio 8:2) 10.4 g/m$^2$ having an average molecular weight of 50,000 and 1,4-bis(2,3-epoxypropoxy)-butane 0.1 g/m$^2$;

(2) a neutralization timing layer containing acetyl cellulose 4.3 g/m$^2$ having an acetylation degree of 51% and poly(methyl vinyl ether-co-monomethyl maleate) 0.2 g/m$^2$;

(3) a layer containing the whole solid matters 2.5 g/m$^2$ consisting of a polymer latex prepared by emulsion-polymerizing styrene/butyl acrylate/acrylic acid/N-methylolacrylamide in the weight ratio 49.7:42.3:4:4 and a polymer latex prepared by emulsion-polymerizing methyl methacrylate/acrylic acid/N-methylolacrylamide in the weight ratio 93:3:4, wherein the polymer latexes were blended so that the solid matters ratio became 6:4; and (4) a layer containing gelatin 1 g/m$^2$.

The alkali processing composition was prepared in the following manner.

A processing solution 0.8 g of the following composition was charged into a vessel breakable by pressure.

| | |
|---|---|
| 1-p-Tolyl-4-hydroxymethyl-4-methyl-3-pyrazolidone | 10.0 g |
| Methylhydroquinone | 0.18 g |
| 5-Methylbenzotriazole | 3.0 g |
| Sodium sulfite (anhydrous) | 0.2 g |
| Benzyl alcohol | 1.5 ml |
| Sodium carboxymethyl cellulose | 58 g |
| Carbon black | 150 g |

-continued

| | |
|---|---|
| Potassium hydroxide (a 28% aqueous solution) | 200 ml |
| Water | 680 ml |

Next, the emulsions contained in the 6th layer, 7th layer, 12th layer, 13th layer, 18th layer, and 19th layer of Sample 101 were replaced in order with Emulsion-A1 to Emulsion-A4 and Emulsion-B1 to Emulsion-B4 as shown in Table D, whereby Samples 102 to 107 were prepared.

TABLE D

| | Emulsions used | | | | | |
|---|---|---|---|---|---|---|
| Sample No. | 6th layer | 7th layer | 12th layer | 13th layer | 18th layer | 19th layer |
| 101 (Comp.) | Emulsion-B1 | Emulsion-A1 | Emulsion-B1 | Emulsion-A1 | Emulsion-B1 | Emulsion-A1 |
| 102 (Comp.) | Emulsion-B2 | Emulsion-A2 | Emulsion-B2 | Emulsion-A2 | Emulsion-B2 | Emulsion-A2 |
| 103 (Comp.) | Emulsion-B3 | Emulsion-A3 | Emulsion-B3 | Emulsion-A3 | Emulsion-B3 | Emulsion-A3 |
| 104 (Inv.) | Emulsion-B4 | Emulsion-A4 | Emulsion-B4 | Emulsion-A4 | Emulsion-B4 | Emulsion-A4 |
| 105 (Inv.) | Emulsion-B2 | Emulsion-A2 | Emulsion-B4 | Emulsion-A4 | Emulsion-B2 | Emulsion-A2 |
| 106 (Comp.) | Emulsion-B2 | Emulsion-A2 | Emulsion-B1 | Emul3ion-A1 | Emulsion-B2 | Emulsion-A2 |
| 107 (Comp.) | Emulsion-B2 | Emulsion-A2 | Emulsion-B3 | Emulsion-A3 | Emulsion-B2 | Emulsion-A2 |

The above light-sensitive elements 101 to 107 were exposed from the emulsion layer side via a grey continuous wedge. Then, they were superposed on the above cover sheets and the above processing solution was spread between both the materials with a pressurized roller so that the solution was spread in the thickness of 75 μm. Exposing was carried out at two conditions of 1/100 second exposing and 10 seconds exposing adjusting the exposing illuminance so that the exposure became constant, whereby the relative difference between the sensitivity at a high illuminance exposure (1/100 second exposure) and the sensitivity at a low illuminance exposure (10 seconds exposure) was determined. The processing was carried out at 25° C. The transferred densities were measured with a color densitometer 10 minutes later.

The results thereof are shown in Table E.

TABLE E

Measuring results on relative sensitivity variation by exposing illuminance

| Sample No. | Relative sensitivity variation* Y | M | Cy |
|---|---|---|---|
| 101 (Comp.) | 0.43 | 0.30 | 0.25 |
| 102 (Comp.) | 0.50 | 0.32 | 0.29 |
| 103 (Comp.) | 0.53 | 0.35 | 0.30 |
| 104 (Inv.) | 0.70 | 0.60 | 0.55 |
| 105 (Inv.) | 0.53 | 0.62 | 0.31 |
| 106 (Comp.) | 0.49 | 0.29 | 0.31 |
| 107 (Comp.) | 0.48 | 0.33 | 0.32 |

*value (logarithmic value) of the sensitivity at 10 seconds exposure, relative to the sensitivity at 1/100 second exposure in the concentration of 1.0, which is set at 100.

It was found that there could be obtained in the present invention, an internal latent image type direct postive silver halide emulsion having a decreased reduction in the sensitivity at a low illuminance exposure (low illuminance inversion) and a color diffusion transfer light-sensitive material having a reduced low illuminance inversion.

While the invention has been described in detailed with reference to specific embodiments, it will be apparent to one skilled in the art that various changes and modifications can be made to the invention without departing from its spirit and scope.

What is claimed is:

1. An internal latent image type positive silver halide emulsion comprising a polymer (1) having a repetitive unit derived from an ethylenically unsaturated monomer having at least one thioether structure on a side chain and a polymer (2) having a repetitive unit as defined below, said emulsion having been prepared by using said polymer (1) as a deflocculating agent to form silver halide grains and subjecting the grain surfaces to a chemical sensitization in the presence of said polymer (2), said polymer (2) having a repetitive unit represented by the following Formula (I):

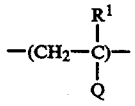

(I)

wherein $R^1$ represents a hydrogen atom or a substituted or unsubstituted alkyl group and Q represents a group selected from the group consisting of a

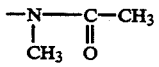

group, a

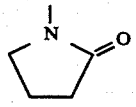

group, and a

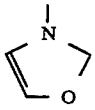

group.

2. The internal latent image type positive silver halide emulsion of claim 1, wherein polymer (1) is added in an amount of 0.1 to 150 g per 1 mole of silver halide.

3. The internal latent image type positive silver halide emulsion of claim 1, wherein polymer (2) comprises the repetitive unit of Formula (I) in an amount of 10 to 100 mole %.

4. The internal latent image type positive silver halide emulsion of claim 1, wherein $R^1$ represents a hydrogen atom:

5. The internal latent image type positive silver halide emulsion of claim 1, wherein polymer (2) has a molecular weight of 8,000 to 700,000.

6. The internal latent image type positive silver halide emulsion of claim 1, wherein polymer (2) is added so that the total amount of the repetitive unit of Formula (I) is 0.002 to 1 g per 1 mole of silver.

7. The internal latent image type positive silver halide emulsion of claim 1, wherein the silver halide grains are core/shell type.

8. A color diffusion transfer light-sensitive material comprising a support having provided thereon at least one silver halide emulsion layer combined with a dye image-forming material, the dye image-forming material being represented by the following Formula (II) and comprising a non-diffusible compound which releases a diffusible dye or a precursor thereof in relation to silver development or a compound whose diffusibility is varied in relation to silver development, wherein at least one silver halide emulsion layer contains an internal latent image type positive silver halide emulsion as recited in claim 1:

$$(DYE\text{-}Y)_n-Z \qquad \text{(II)}$$

wherein DYE represents a dye group, a dye group whose absorption has been temporarily shifted to a short wavelength range or a dye precursor group; Y represents a single bond or a connecting group; Z represents a group which causes a difference in the diffusibility of the compound represented by $(DYE\text{-}Y)_n-Z$ in correspondence to or counter correspondence to light-sensitive silver salt having an imagewise latent image or releases DYE to cause a difference in the diffusibility between DYE thus released and $(DYE\text{-}Y)_n-Z$ in correspondence to or counter correspondence to light-sensitive silver salt having an imagewise latent image; n represents 1 or 2; and when n is 2, the two DYE-Y's may be the same or different.

9. The internal latent image type positive silver halide emulsion of claim 1, wherein Q represents a

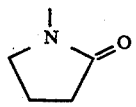

group.

* * * * *